US007905776B2

(12) United States Patent
Sines

(10) Patent No.: US 7,905,776 B2
(45) Date of Patent: Mar. 15, 2011

(54) METHODS AND APPARATUS FOR PLAYING A WAGERING GAME OF CHANCE WITH A PAYOUT SCHEDULE

(75) Inventor: Randy D. Sines, Spokane, WA (US)

(73) Assignee: Digideal Corporation, Spokane, WA (US)

( * ) Notice: Subject to any disclaimer, the term of this patent is extended or adjusted under 35 U.S.C. 154(b) by 1581 days.

(21) Appl. No.: 11/100,795

(22) Filed: Apr. 7, 2005

(65) Prior Publication Data

US 2006/0246976 A1 Nov. 2, 2006

(51) Int. Cl.
*A63F 9/24* (2006.01)

(52) U.S. Cl. ..... 463/25; 463/11; 463/13; 463/20; 463/42; 273/292

(58) Field of Classification Search ..... 273/292; 463/11, 13, 20, 25, 42
See application file for complete search history.

(56) References Cited

U.S. PATENT DOCUMENTS 4,614,342 A * 9/1986 Takashima ..... 463/11
5,382,025 A * 1/1995 Sklansky et al. ..... 273/292
5,618,045 A * 4/1997 Kagan et al. ..... 463/40
5,669,817 A * 9/1997 Tarantino ..... 463/13
5,984,779 A * 11/1999 Bridgeman et al. ..... 463/16
6,386,975 B1 * 5/2002 Peterson ..... 463/16
6,561,891 B2 * 5/2003 Eppert, Jr. et al. ..... 451/530
6,569,013 B1 * 5/2003 Taylor ..... 463/13
7,364,510 B2 * 4/2008 Walker et al. ..... 463/42
7,651,395 B2 * 1/2010 Van Luchene ..... 463/29
7,695,358 B2 * 4/2010 Walker et al. ..... 463/13
2003/0119579 A1 * 6/2003 Walker et al. ..... 463/20
2003/0224856 A1 * 12/2003 Bukovsky et al. ..... 463/42
2007/0129123 A1 * 6/2007 Eryou et al. ..... 463/1

* cited by examiner

*Primary Examiner* — Dmitry Suhol
*Assistant Examiner* — Ryan Hsu
(74) *Attorney, Agent, or Firm* — Mark Farrell Patent Law PC; Mark Farrell

(57) ABSTRACT

Representative embodiments provide for methods of playing a wagering game of chance, including defining a payout schedule, dealing an initial hand to at least one player, and accepting a final bet from the at least one player so as to define at least one final betting player. Other method steps include dealing one or more community cards, wherein at least one of the community card is selectively combined with at least one card within each initial hand such that a final hand is defined for each final betting player, and awarding a payout to each final betting player holding a final hand that so qualifies in accordance with the payout schedule. Other embodiments provide for respective gaming tables and individual gaming machines including respectively electronic controllers, each controller configured to execute one or more method steps in accordance with the present embodiments provided for herein.

21 Claims, 17 Drawing Sheets

METHODS AND APPARATUS FOR PLAYING A WAGERING GAME OF CHANCE WITH A PAYOUT SCHEDULE

BACKGROUND

Various kinds of wagering games of chance (hereinafter, wagering games) are known. Examples of such wagering games include craps, blackjack (twenty-one), baccarat, etc. Play of such a wagering game typically involves a player's individual skill, playing strategy, and some degree of probabilistic chance operating within the rules of the game to determine a winner or winners. Commonly, wagering games are played within a casino, card house, or similar establishment in which players can enjoy numerous amenities such as beverage and food services, cashier services, lines of credit, personal security, or other resources that generally make for an attractive atmosphere in which to play such wagering games.

Generally, players take significant interest in a particular type of wagering game and the challenge offered in playing that game well. As a result, some degree of variation in the rules and/or other dynamics of play are sought by a number of players so that the particular wagering game of choice continues to provide interest and excitement. One such variation sought by some players is the manner or structure by which a winning hand or hands are paid or awarded. Furthermore, an increasing number of wagering games can now be played in a manner that is, to some extent, computerized or automated. In such a venue, certain tasks such as, for example, the dealing of cards, accounting for wagers, and the awarding of winnings is handled automatically so that players are better able to concentrate on and enjoy the play of the game.

Therefore, it is generally desirable to provide methods and apparatus for playing wagering games that provide interest and excitement to the players.

SUMMARY

The present disclosure provides for any number of different embodiments of the wagering game of chance, and methods and apparatus for performing the same. Typical (but not required) to each embodiment is the use of a standard poker deck, including the optional use of one or more jokers and/or wildcards. Also typical to each embodiment is a corresponding payout schedule which determines an award (or prize) that is paid by the house (game host) to each player or players in accordance with their final hand. Generally, such a payout schedule is defined once and governs the award or awards given to players over the course of several instances of the wagering game of chance. In this way, the players are actually playing in accord with the payout schedule itself, rather than competing directly against each other over a single pot. Furthermore, betting (wagering) during a particular embodiment of the wagering game of chance can be performed substantially simultaneously by each of the players. As a result, the overall progress (play) of the game is generally faster than that of known styles of wagering game play.

Also provided are substantially automated (i.e., electronic) venues for playing various embodiments of the wagering games of chance as provided for herein. Such venues include a wager gaming table configured to provide play for a plurality of players, as well as individual gaming machines that can be played solo or as a multi-player collective network. Various embodiments provided for herein can also be played in a more traditional environment on a known gaming table (e.g., a poker table) through the use of conventional playing cards and wagering chips, etc. Also, certain embodiments of the wagering game of chance provided for herein include the dealing of all cards in a face-up condition. Numerous variations on the exemplary embodiments described hereinafter can be defined and used in accordance with the scope of the present disclosure.

One embodiment provides a method of playing a wagering game of chance, the method including the steps of defining a payout schedule and dealing an initial hand to one or more players. The method also includes the step of accepting a final bet from at least one of the players, thus defining at least one final betting player. The method includes the step of dealing one or more community cards, wherein at least one of the community cards is selectively combined with at least one card within each of the initial hands so that a final hand is defined for each of the final betting players. Further, the method includes the step of awarding a payout to each final betting player holding a final hand that qualifies in accordance with the payout schedule.

Another embodiment provides a method of playing a wagering game of chance, the method including the steps of defining a payout schedule, and accepting an initial bet from at least one player, such that at least one initial betting player is defined. The method also includes the steps of dealing an initial hand to each initial betting player, accepting a first bet from at least one initial betting player such that at least one first betting player is defined, and dealing a "flop" of at least one community card. The method includes the additional steps of accepting a second bet from at least one first betting player such that at least one second betting player is defined, dealing a "turn" of at least one community card, and accepting a third bet from at least one second betting player such that at least one final betting player is defined. The method also includes the step of dealing a "river" of least one community card, wherein each of the "flop" and "turn" and "river" community cards is selectively combined with at least one card within each of the initial hands so as to define a final hand for each of the final betting players. The method further includes the step of awarding a payout from a house to each final betting player holding a final hand that so qualifies in accordance with the payout schedule.

These and other aspects and embodiments will now be described in detail with reference to the accompanying drawings, wherein:

DETAILED DESCRIPTION

Figure 1:
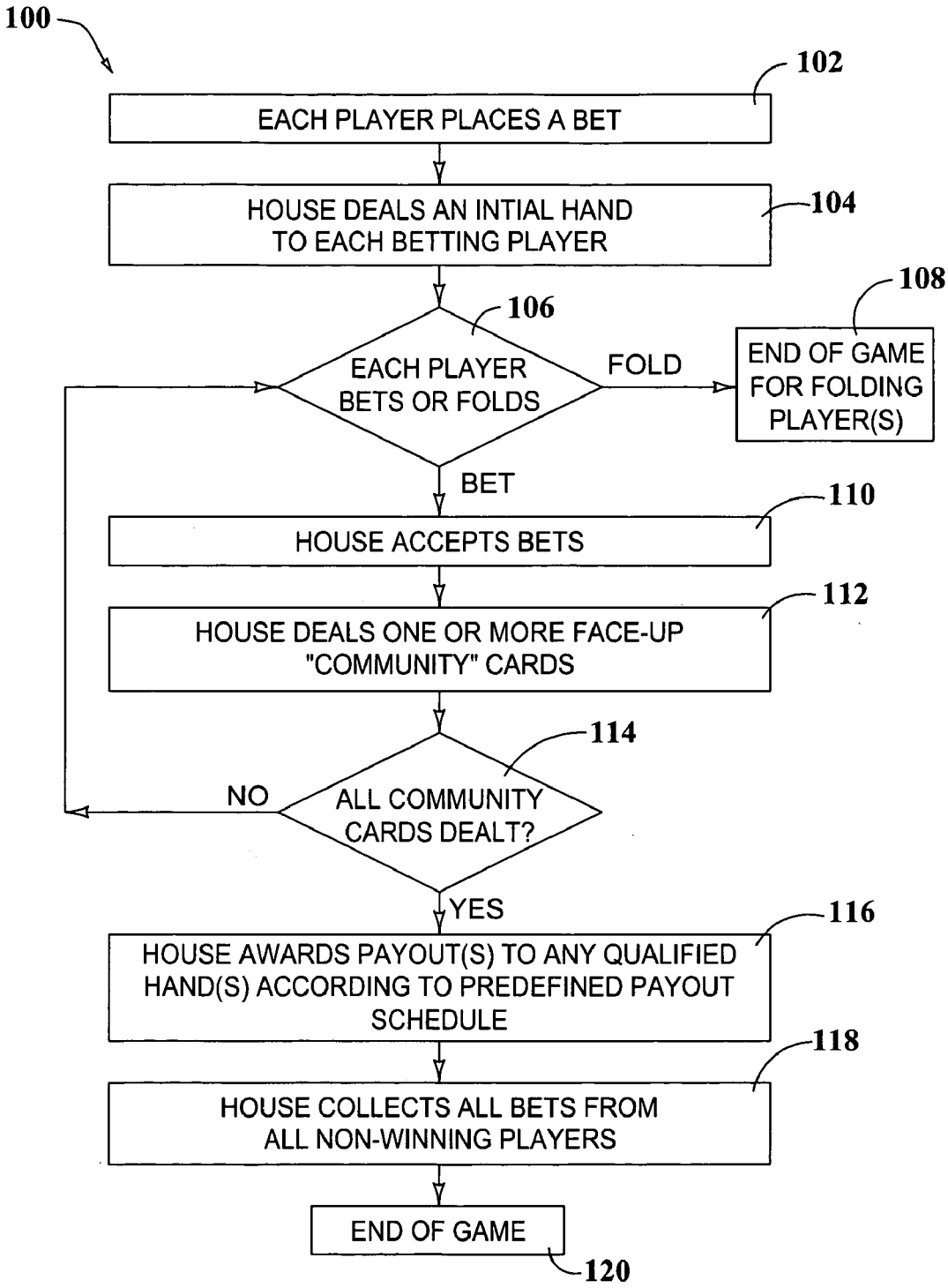
FIG. 1 is a flowchart depicting a method of playing a wagering game of chance in accordance with one embodiment.

In representative embodiments, the present teachings provide methods and apparatus for playing a wagering game of chance.

Certain terms are used and applied herein that are generally defined as follows:

House: The house is a game administrator or host for playing a game or games in accordance with the teachings provided for herein. In some circumstances, the house can be generally defined by a casino, or the agents thereof, which is/are authorized to define particular rules or other aspects of playing the game or games provided for herein. In other situations, the house can be defined by one or more individuals hosting or otherwise officiating the play of a game or games as provided herein. Such individuals are commonly referred to as dealers.

Initial Hand: An initial hand comprises one or more cards dealt to each of one or more players. Thus, each player has (i.e., holds) a corresponding initial hand. In certain embodiments provided for herein, each player is provided a preliminary hand of two or more cards dealt in a face-up condition, from which one or more of these cards are selectively discarded by the corresponding player in order to define that player's initial hand. An initial hand is generally considered "initial" in the sense that it typically comprises some of the first cards to be dealt during a given instance of a game. An initial hand can also comprise one or more cards dealt in a face-up condition, and/or one or more cards dealt in a face-down condition, to each of one or more players.

Community Card: A community card refers to any card that is available to any of one or more players during a present instance of a game. More particularly, each community card is available to be selectively combined with one or more cards of a player's initial hand in order to define a final hand (described in detail below) for that player. Typically, one or more community cards are dealt in a face-up condition at various respective times during the course of a game or games provided for herein. However, in one variation one or more of the community cards can be dealt in a face-down condition.

Final Hand: A final hand comprises the selective combination of at least one card from the corresponding player's initial hand with at least one community card so as to result in a predefined total card count. In certain embodiments, a final hand is defined as a total of five cards selectively combined as just described. Other card counts can also be used in accordance with embodiments provided for herein. A final hand is generally considered "final" in the sense that it comprises some selective combination—that is, a subset—of all of the initial hand cards and all of the community cards that were made available (dealt) to the corresponding player during the course of the present game.

Placing a Bet: A player places a bet by setting a wagering chip (or chips), amount of money, or other item (or items) of value into a designated area. Such an area is typically located in front of or proximate to that player on a wager gaming table or other playing surface. The timing, amount and/or procedure for placing a bet are determined in accordance with the embodiment of wagering game of chance presently being played. In some embodiments, a player places a bet by inputting a command or instruction into an electronic user interface. Other methods of placing a bet can also be used. One of skill in the wager gaming arts is familiar with numerous ways of placing a bet that are generally consistent with the present teachings.

Payout Schedule: A payout schedule comprises a predefined list or table of one or more final hands in one-to-one correspondence with an award or prize that is given to a player upon achieving such a final hand. Generally, the final hands listed on a particular payout schedule are ordered in accordance with a predetermined (and usually, but not necessarily, well known) ranking of poker hands. Furthermore, the award corresponding to each final hand is usually in the form of a multiplier (ratio or coefficient), such that the amount awarded to a player is equal to the cumulative bet or bets placed by that player during the current game times the multiplier. The house typically defines and provides the payout schedule to the players prior to the start of a wagering game of chance. A sequence of wagering games can use the same payout schedule for each game, or the payout schedule may vary during the sequence of games, in accordance with the particular embodiment of the wagering game of chance. As also used herein, the payout schedule that governs any amounts awarded during a particular game is referred to as the prevailing payout schedule for that game.

Register: The terms register, registering and registration generally refer to various recording operations performed by automated, or partially automated, embodiments provided for herein. As such, registration typically means the recording of a quantity or entity identification, a player choice or action, or some other game-related data within a computer-accessible storage media (such as a memory, etc.) by a corresponding processor. Non-limiting examples include: registering a bet or bets as they are made (or placed) by players; registering one or more cards as they are selectively discarded by a player; registering one or more final hands; registering an award or awards to a player or players; etc.

Valid Player: A valid player is any player that has met one or more sequential requirements for ongoing participation in a present instance of a game. Typically, a valid player is one that has opted to place the most recently required bet in order to advance in play of the present game. In contrast, a player that has opted to quit (i.e., "fold") is not considered a valid player for purposes of the present instance of a game.

Accepting a Bet: A particular bet is accepted when the placement of that bet is acknowledged (i.e., detected, confirmed and/or noted) by the house. Such an acknowledgment can include, but does not necessarily require, a verbal, visual or other communication to that particular betting player by the house. Thus, accepting a bet generally refers to an act of verification, whether it is communicative in nature or not, that is performed by the house.

Turning now to FIG. 1, a flowchart 100 depicts a method for playing a wagering game of chance in accordance with one embodiment. While the method depicted by flowchart 100 describes particular steps and order of execution, it is to be understood that other embodiments that respectively include other steps and/or orders of execution can also be used in accordance with the teachings provided for herein. To begin, it is assumed that the house has predefined a payout schedule for use in playing the current instance of the wagering game of chance.

In step 102 of flowchart 100, each of one or more players places a bet. The amount of each players bet can be the same (equal), or the amounts can vary from player to player in accordance with the present embodiment of wagering game. For purposes of example, it is assumed that each player places a bet of two dollars. In any case, the house keeps track of the amount of each player's bet by way of manual, electronic or other means. Furthermore, each player placing a bet in step 102 is defined to be a betting, or valid, player.

In step 104, the house deals an initial hand of one or more cards—in accordance with the present embodiment of wagering game being played—to each of the players placing a bet in step 102 above. For purposes of example, it is assumed that an initial hand of two cards is dealt in a face-up condition to each betting player and that a full hand constitutes five cards total for the present embodiment of the game. Other card counts corresponding to other initial hands and/or full hands, as well as other face-up or face-down card dealing procedures, can also be used. Further, it is assumed that cards used during play are dealt from a standard (fifty-two card) poker deck or its equivalent. Further still, one or more standard jokers, and/or wild cards, can also be used. As a result of the face-up condition of the initial hand (in this example), all players can see (or be otherwise made aware) of the content of each and every initial hand.

In step 106, each betting player decides if they are to continue or quit (i.e., 'fold') at this point without further play of the present wagering game of chance. Those players who elect to quit continue to step 108 below. Each player electing to continue play places another bet and, as a result, maintains their status as a betting (or valid) player. For purposes of the ongoing example, it is assumed that each player electing to continue places a bet (i.e., a "first bet") of two dollars. As a result, in this example, each player electing to continue play in step 106 has wagered a total of four dollars so far in the present game. The method of the flowchart 100 now proceeds to step 110 below for those players electing to continue play. It is to be understood that, in another embodiment of the wagering game, each player can elect to place a first bet of a respectively varying amount. It should be further pointed out that the "first bet" is to be distinguished from the "initial bet". That is, an "initial bet" is accepted prior to dealing any cards, and a "first bet" is accepted after a player has received his or her initial hand, and elects to stay in the game by placing a bet. It should also be noted that in one variation no "initial bet" is accepted, and the first act of betting by a player is placing the "first bet" after receiving his or her initial hand. That is, the games provided for herein can be played with or without the use of an "initial bet" (i.e., a bet accepted prior to any cards being dealt to the specific players). It will also be appreciated that the "first bet" (accepted after the initial hand has been dealt) can also be defined as a "final bet".

In step 108, those players electing to quit in step 106 above, do so. The present instance of the game of the flowchart 100 is now ended for those players. However, players that fold at this point are eligible to continue play in the next (sequential) instance of the wagering game of chance. The house takes possession of (collects) any bets placed thus far in the present game by any and all players electing to quit in step 108.

In step 110, the house accepts (i.e., verifies and/or records) any bet or bets placed in step 106 above. In this way, each player's betting is generally considered to be cumulative in nature, growing in value with each instance of betting (i.e., wagering) that occurs as described in steps 104 and/or 106 above, until any final bet or bets (described in further detail hereafter) are accepted by the house.

In step 112, the house deals one or more 'community' cards in a face-up condition. Each of the community cards is available to be selectively combined with at least one card within each initial hand—in accordance with the present embodiment of game being played—so as to define a best present hand for each continuing (i.e., betting, or valid, player). For purposes of the present example, it is assumed that three community cards are dealt in a face-up condition, such that each valid player now has a total of five available cards that can be selectively combined so as to define a present hand of five cards. It is further assumed for purposes of example that each player must include both cards of their initial hand within the selective combination defining their (best) present hand of five cards.

In step 114, it is determined if all of the community cards have been dealt in accordance with the present embodiment of the game being played. If all community cards have been dealt, then the method of the flowchart 100 proceeds to step 116 below. If one or more community cards are yet to be dealt, then the steps 106-114 are repeated one or more additional times prior to proceeding on to step 116.

For purposes of the present example, it is assumed that two more community cards remain to be dealt. Thus, under the present example: Step 106 is repeated, in which each presently valid player elects to fold (i.e., proceed to step 108) or place a second bet (in this example, of two dollars)—which in this exemplary case is a final bet—in order to continue; then step 110 is repeated, in which the final bet(s) is/are accepted by the house; then step 112 is repeated, in which two more community cards are dealt in a face-up condition; and then the method of the flowchart 100 returns to step 114, where it is determined that all necessary iterations of steps 106-112 above are complete with respect to the present instance of the game. Under the present example, there are now five community cards total that can be selectively combined with each initial hand (of two cards) so as to define a best present hand (of five cards) for each respective final betting player.

It is important to understand that there is a bet (e.g., the second bet, etc.) placed by each continuing player (e.g., during step 106 above, etc.) that defines a final bet. Such a final bet (or bets) is (or are) typically placed during the last iteration of step 106 as performed in accordance with the particular embodiment of the present game. Thus, under the present example, each second betting player has, by definition, placed a final bet and is defined to be a final betting player. Furthermore, each best present hand held by a final betting player is defined to be a (best) final hand. In any event, the method of the flowchart 100 now proceeds to step 116 below.

In step 116, the house determines which (if any) of the final betting players holds a final hand that qualifies for an award in accordance with the prevailing payout schedule for the present wagering game. For purposes of the ongoing example, it is assumed that there are a total of four final betting players, of which a first final betting player has a final hand comprising a pair of kings, and a second final betting player has a final hand comprising a pair of queens and a pair of sixes (i.e., two pair). It is further assumed that the payout schedule calls for a 1:1 payout (or multiplier) to the first final betting player and a 2:1 payout to the second final betting player. The third and fourth final betting players are each assumed to have final hands that do not qualify for an award in accordance with the prevailing payout schedule.

Under the example, the house awards the first final betting player one times his cumulative bet of six dollars for an award of six dollars, whereas the house awards the second final betting player two times his cumulative bet of six dollars for an award of twelve dollars. Thus, the house pays a total of eighteen dollars to the first and second final betting players. In addition to paying the indicated awards to the two winning players, the winning players typically retract (take possession of) their respective total bets. So, for example, the first final betting player receives a total of twelve dollars, and the second final betting player receives a total of eighteen dollars.

In step 118, the house collects (i.e., takes possession of) all bets that were placed during the course of the present wagering game by any non-winning (final betting) players. Thus, any such bet or bets are considered "lost" from the perspective of such non-winning players. In the ongoing example, all bets placed by the third and fourth final betting players are collected by the house—a grand total of twelve dollars.

In step 120, the present instance of the wagering game of chance is considered complete. The method of the flowchart 100 can be repeated in an iterative fashion thus defining a sequence of wagering games wherein, if desired, the same (predetermined) payout schedule prevails (or governs) during each game.

The method of the flowchart 100 generally describes one possible embodiment of playing a wagering game of chance in accordance with certain embodiments provided for herein. Other embodiments corresponding to other steps, procedures and/or orders of execution can also be used. It is important to note that numerous aspects of the method of the flowchart 100 can be suitably varied, typically by the house and/or in accordance with player agreement. For example, the initial bet (e.g., as in step 102 above) can be eliminated within certain embodiments. In another example, certain embodiments include three rounds of betting (i.e., three iterations of step 106, etc.) after placing an initial bet, thus defining first, second and final bets, respectively. In any embodiment of the present invention all bets that are placed prior to the final bet are also considered to be non-final bets. Thus, for example, in an embodiment including initial, first and final rounds of betting, each of the initial and first bets are also referred to as non-final bets in the interest of further distinction.

In another example, certain embodiments include the definition of a jackpot qualifying hand prior to the start of the wagering game or sequence of wagering games. Typically, the jackpot qualifying hand is defined by the house. Such a jackpot qualifying hand can comprise, for example, a straight flush as defined by conventional poker hand ranking schemes. Thereafter, in some such embodiments, the following steps are included: each player electing to do so places a side bet into a progressive jackpot at some generally initial step in each game (e.g., during step 102 above), wherein the progressive jackpot is separate and distinct from any other bet or bets that are later taken by the house (e.g., in step 118 above). As such, each player placing a final bet (as in step 106 above, etc.) who has also placed a side bet is also defined to be a jackpot participating player. Thereafter (e.g., in step 116, etc.), the progressive jackpot is awarded to a jackpot participating player that holds a final hand that is also a jackpot qualifying hand—in this example, a straight flush. However, if no jackpot participating player holds a final hand that is also a jackpot qualifying hand, the progressive jackpot is carried forward or "rolled over" into the next game of a sequence of wagering games of chance, until the progressive jackpot is eventually awarded to a player (or split between jackpot participating players in the event of a tie, etc.).

In still another example, certain embodiments include a jackpot qualifying hand that is predefined by the house prior to a game or sequence of wagering games of chance. Thereafter, some such embodiments include the following steps: a predefined portion (i.e., a percentage or flat amount, etc.) is taken from the cumulative total of the player(s) bets (comprising the initial bet(s) and final bet(s), etc.) and transferred into a progressive jackpot (e.g., during step 116 above, etc.). Also, in such an embodiment, any final betting player is also considered to be a jackpot participating player. Thereafter, the progressive jackpot is awarded to a jackpot participating player that holds a final hand that is also a jackpot qualifying hand (e.g., in step 118 above, etc.). If no jackpot participating player holds a final hand that is also a jackpot qualifying hand, the progressive jackpot is "rolled over" into the next game of a sequence of wagering games of chance, until the progressive jackpot is eventually awarded to a player or players (i.e., split between tying jackpot participating players, etc.).

In yet another example, certain embodiments include dealing an initial hand (e.g., as in step 104 above, etc.) as follows: two or more cards are dealt in a face-up condition so as to define a respective preliminary hand for each player. Each player then selectively discards at least one of the cards from their preliminary hand so as to define an initial hand for that player. Typically, such dealing of an initial hand is performed after any initial betting (e.g., step 102 above, etc.), but prior to the dealing of any community cards. Other variations of dealing an initial hand can also be used in accordance with other embodiments of the wagering game of chance provided herein.

In another example, certain embodiments include plural rounds of betting (e.g., as in step 106, etc.) wherein each subsequent bet is of an increased amount relative to the most recent prior bet. In one embodiment, for example, a first bet is made (placed) comprising one unit of value, followed by second and third bets of two units and three units of value, respectively. Other escalating (or deescalating) betting schemes can also be used in accordance with embodiments provided for herein.

In yet another example, certain embodiments include three iterations of dealing community cards (e.g., as in step 112 above, etc.) as follows: On a first iteration, three community cards referred to as 'flop' cards are dealt in a face-up condition (followed by steps 114 and 106-110 above, etc.); thereafter one community card referred to as a 'turn' card is dealt in a face-up condition (followed by steps 114 and 106-110 above, etc.); and then finally one community card referred to as a 'river' card is dealt in a face-up condition. Other variations, including other formats for dealing community cards, can also be used in accordance with embodiments provided for herein.

The method of the flowchart 100 and numerous possible variations thereon are described above in the context of dealing conventional cards (of pasteboard or plastic construction, etc.) to one or more players, while money or playing chips are typically used for purposes of placing bets, the paying of any award or awards, etc. However, it is within the scope of embodiments provided for herein to play any or all of the various embodiments by way of a gaming table, an individual gaming machine or a network of such machines, or by other means that are at least partially automated, wherein virtual images (i.e., images presented on a display screen) of cards and/or betting chips, etc., are used to facilitate play of the game. Certain of such (at least partially) automated means are described hereinafter.

Figure 2A:
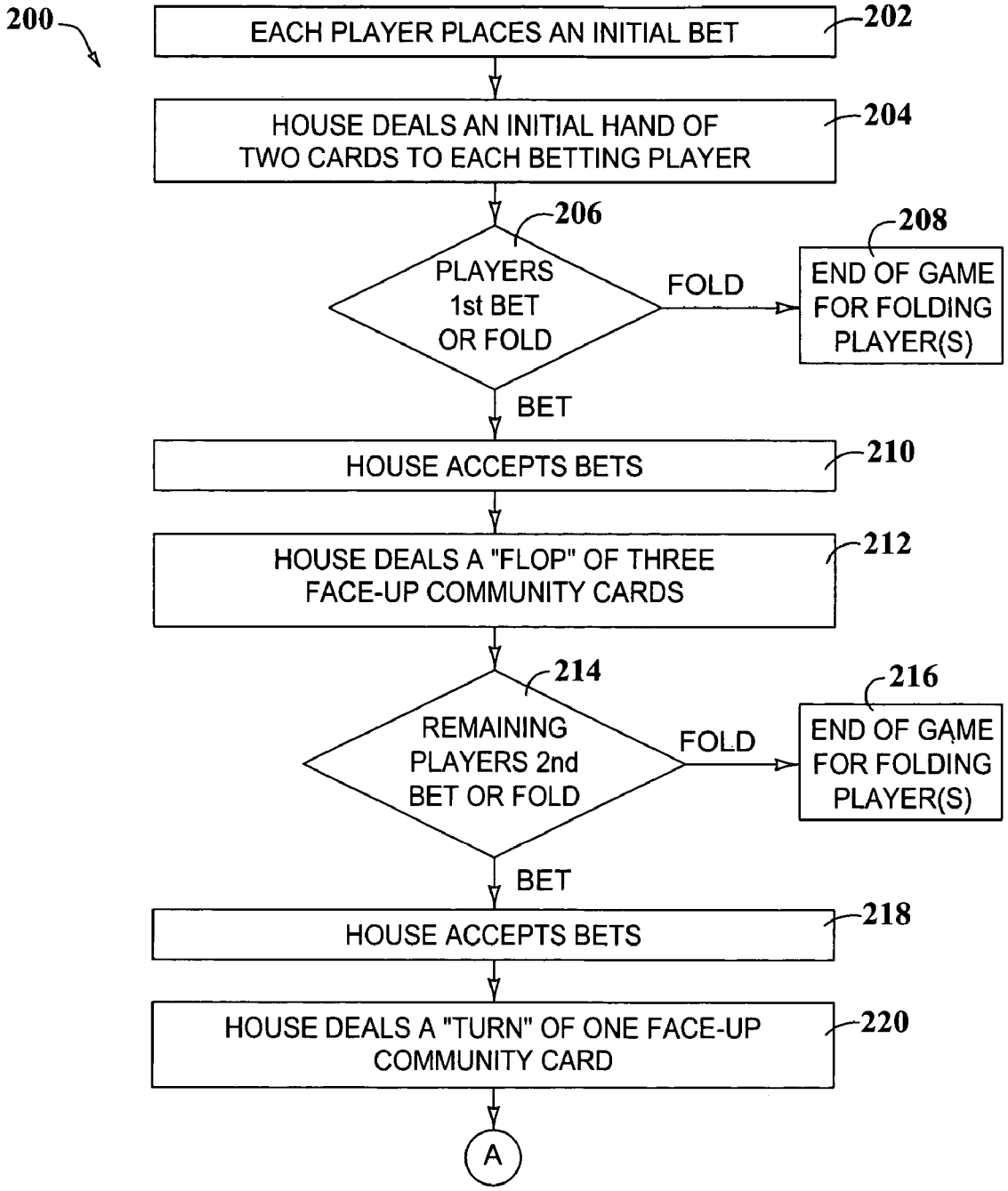
FIG. 2A is a flowchart depicting a method of playing a wagering game of chance in accordance with another embodiment.
Figure 2B:
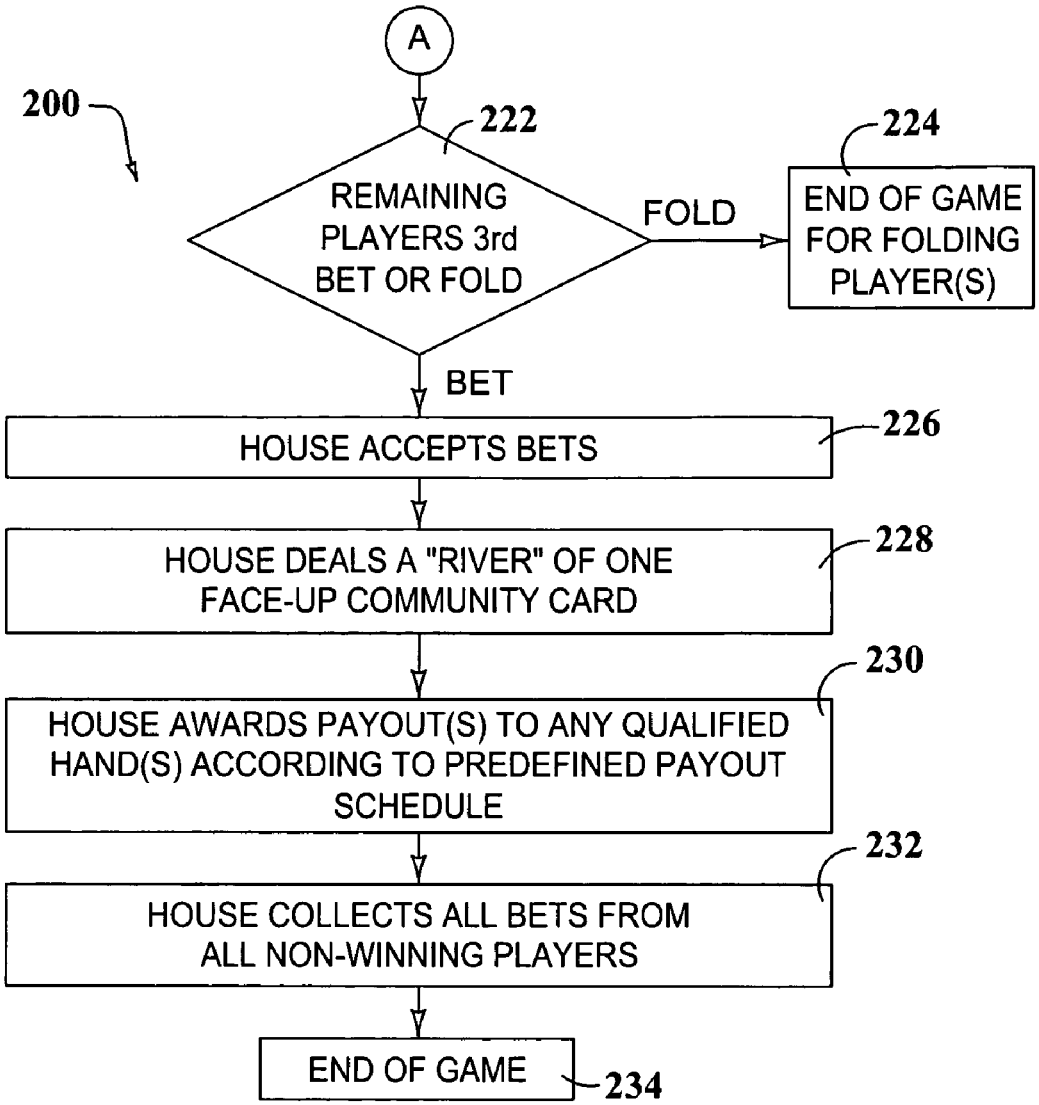
FIG. 2B is a continuation of the flowchart of FIG. 2A.

FIGS. 2A-2B collectively are a flowchart 200 depicting a method of playing a wagering game of chance in accordance with another embodiment. While the flowchart 200 describes particular steps and order of execution, it is to be understood that other embodiments that respectively include other steps and/or orders of execution can also be used in accordance with the teaching of the present disclosure. To begin, it is assumed that the house has defined a payout schedule that will govern any awards given during the present wagering game of chance.

In step 202 (FIG. 2A), each player places an initial bet as an initial qualification for participating in the present instance of the wagering game. All of the initial bets can be of equal amounts, or may vary in amount from player to player, in accordance with the particular rules of the present wagering game. For purposes of example, it is assumed that each player places a mutually equal initial bet of five dollars.

In step 204, the house deals a respective initial hand of two cards in a face-up condition to each of the players having placed an initial bet in step 202 above (i.e., each 'valid' or betting player). Thus, each betting player has an initial hand that is visible to, or otherwise ascertainable by, each of the other players.

In step 206, each of the current players decides to either place a "first bet" (as defined herein above) or to fold (quit). Those players electing to fold proceed to step 208 below. All of the first bets can be of mutually equal amounts as predefined by the house, or can vary in amount from player to player, in accordance with the rules of the present game. In one embodiment, each first bet is of an amount equal to or greater than the amount of each initial bet. For purposes of ongoing example, it is assumed that each valid player electing to continue places a first bet of five dollars. Each player placing a first bet is now defined as a first betting player and continues on to step 210 below. As also indicated above, in one variation the requirement to place an "initial bet" can be deleted from the game, and the betting commences with the player or players placing the "first bet".

In step 208, each player electing to quit in step 206 above, does so. The present instance of the wagering game of chance of the flowchart 200 is now considered complete for such a player or players. The house takes possession of the initial bets placed by any and all players electing to quit in step 208.

In step 210, the house accepts any and all of the first bets placed during step 206 above.

In step 212, the house deals three community cards, respectively known as 'flop' cards, in a face-up condition. Each 'flop' card is available to be selectively combined with the two cards within each initial hand so as to define a present hand (of five cards) for each first betting player. Thus, each first betting player now has the opportunity to evaluate the relative rank or 'strength' of their present hand with respect to the hands of the payout schedule governing the present game.

In step 214, each first betting player now elects to continue the present game or to fold at this time. Those players electing to fold (quit) proceed to step 216 below. Those first betting players electing to continue the game each place a second bet. Again, each of the second bets can be of mutually equal amounts or can vary from player to player in accordance with the present rules. In one embodiment, each second bet is defined by an amount twice that of each first bet. Other betting schemes or escalating bet strategies can also be used. For purpose of the ongoing example, it is assumed that each valid player electing to continue places a second bet of five dollars, and is thus defined as a second betting player. Regardless of the betting amount, each of the second betting players now proceeds to step 218 below.

In step 216, each player electing to quit in step 214 above, does so. The present instance of the wagering game of chance of the flowchart 200 is now considered complete for such a player or players. The house takes possession of (i.e., collects) the initial and first bets placed by any and all players electing to quit in step 216.

In step 218, the house accepts (i.e., verifies, and/or acknowledges) any and all of the second bets placed during step 214 above.

In step 220, the house deals one more community card, known as a 'turn' card, in a face-up condition. The 'turn' card and each of the three 'flop' cards are available to be selectively combined with the two cards within each initial hand so as to define a best present hand (of five cards) for each second betting player. Therefore, each second betting player now has the opportunity to evaluate their best present hand with respect to the hands of the payout schedule.

In step 222 (FIG. 2B), each second betting player now elects to continue the present game or to quit (fold) at this time. Those players electing to quit proceed to step 224 below. Those second betting players electing to continue each place a third bet defining a final bet. Each of the third (final) bets can be of mutually equal amounts or can vary in accordance with the rules. In one embodiment, each final (i.e., third) bet is defined by an amount triple that of each first bet. Other betting strategies or schemes can also be used. For purposes of ongoing example, it is assumed that each second betting player electing to continue places a final bet of five dollars, and is thus defined a final betting player. In the ongoing example, each final betting player has wagered a cumulative total of twenty dollars during the present game. In any case, each of the final betting players now proceeds to step 226 below.

In step 224, each player electing to quit in step 222 above, does so. The present instance of the wagering game of chance of the flowchart 200 is now considered complete for such a player or players. The house takes possession of the initial, first and second bets placed by any and all players electing to quit in step 224.

In step 226, the house accepts any and all of the final bets, placed during step 222 above.

In step 228, the house deals one final community card, known as a 'river' card, in a face-up condition. The 'river' card, the 'turn' card and each of the three 'flop' cards are available to be selectively combined with both of the two cards within each initial hand so as to define a best present hand (of five cards), also defined as a final hand, for each final betting player. Thus, under the ongoing example, any three of the five total community cards (i.e., three flop, one turn and one river cards, respectively) can be selectively combined with each initial hand (of two cards) so as to define a final hand (of five cards) held by each final betting player.

In step 230, the house evaluates each of the (best) final hands in accordance with the hands listed on the prevailing payout schedule, so as to determine what respective amount, if any, is to be awarded to each of the final players. For purposes of the present example, it is assumed that there are three final betting players total, wherein a first final betting player holds a pair of queens, a second final betting player holds only an ace-high final hand (no pair or better), and a third final betting player holds a final hand comprising a straight. It is further assumed, for purposes of the example, that the prevailing payout schedule calls for a 1:1 payout for the first final betting player and a 5:1 payout (or multiplier) for the third final betting player. Under this example, the payout schedule calls for no payout for the second final betting player. Thus, it is assumed that the first and third final betting players are awarded twenty dollars and one hundred dollars, respectively, by the house. Furthermore, each winning final betting player is permitted to reclaim the total of their bets placed during play of the present game.

In step 232, the house takes possession of (collects) any and all bets (i.e., initial, first, second and final) placed by non-winning (final betting) players during the course of the present wagering game of chance. Thus, under the ongoing example, the house collects a total of twenty dollars from second final betting player.

In step 234, the present instance of the wagering game of chance is considered complete. The method of the flowchart 200 can be repeated in an iterative fashion thus defining a sequence of wagering games wherein, if desired, the same payout schedule prevails during each game.

The method of the flowchart 200 of FIGS. 2A-2B generally describes one possible embodiment of playing a wagering game of chance in accordance with the present teachings. Other embodiments corresponding to other steps, procedures and/or orders of execution can also be used. It is important to note that numerous aspects of the flowchart 200 can be suitably varied, typically by the house and/or in accordance with player agreement.

For example, the initial bet (e.g., as in step 202 above) can be eliminated within certain embodiments provided for herein. Other forms of placing an initial bet can also be used. In another example, certain embodiments include dealing an initial hand (e.g., as in step 204 above) as follows: three or more cards are dealt in a face-up condition so as to define a preliminary hand for each player. Each player then selectively discards at least one of the cards from their preliminary hand so as to define an initial hand (of two cards) for that player. Typically, such dealing of an initial hand is performed after any initial betting, but prior to the dealing of any community cards. Other embodiments including other variations of dealing an initial hand can also be used in accordance with the present teachings. Still other varying embodiments of the method of the flowchart 200 of FIGS. 2A-2B can be defined and played in accordance with one or more of the embodiments (i.e., variations) described above in regard to the method 100 of FIG. 1.

The method of the flowchart 200 and numerous possible variations are understood to be described above in the context of dealing conventional cards to one or more players, while money or playing chips are typically used for purposes of paying awards, placing bets, etc. However, it is within the scope of the present embodiments to play any or all of the variations of the method of the flowchart 200 of FIGS. 2A-2B by way various respective means that are at least partially automated. Certain of such means are described hereinafter.

Figure 3A:
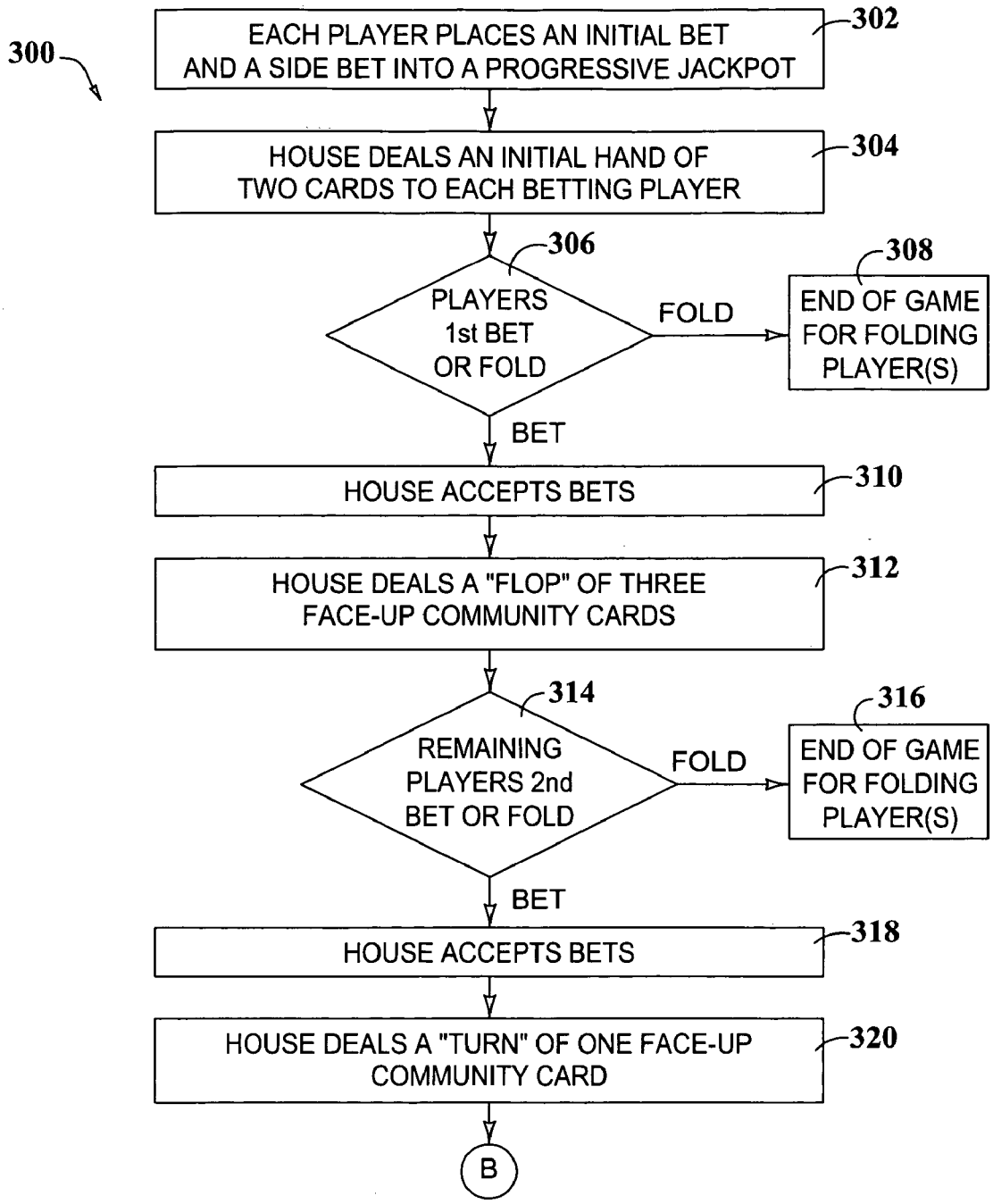
FIG. 3A is a flowchart depicting a method of playing a wagering game of chance in accordance with yet another embodiment.
Figure 3B:
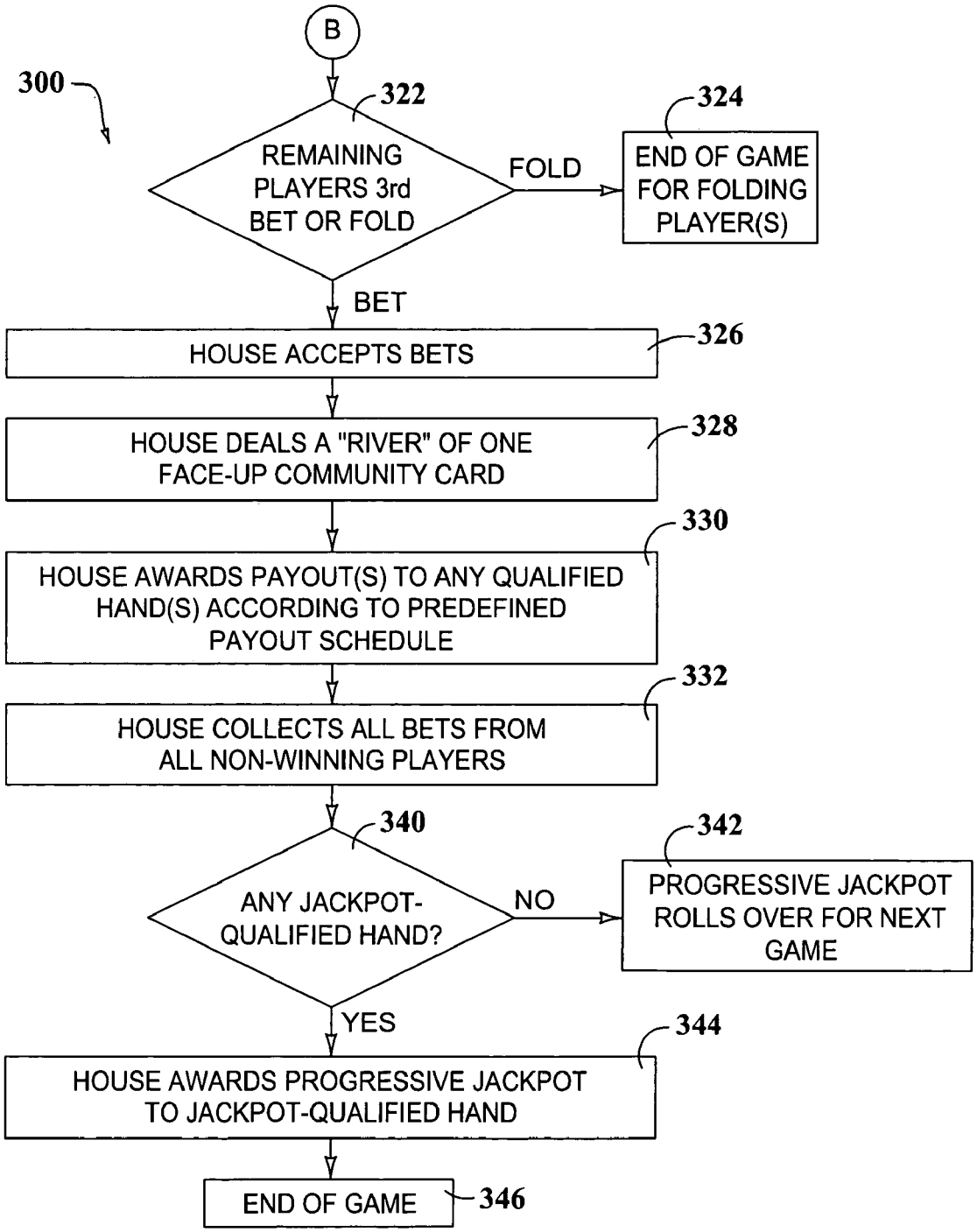
FIG. 3B is a continuation of the flowchart of FIG. 3A.

FIGS. 3A-3B collectively are a flowchart 300 depicting a method of playing a wagering game of chance in accordance with another embodiment. The method of the flowchart 300 depicts one embodiment that includes a progressive jackpot. While the flowchart 300 describes particular steps and order of execution, it is to be understood that other embodiments that respectively include other steps and/or orders of execution can also be used in accordance with the teaching of the present disclosure.

The method of the flowchart 300 of FIGS. 3A-3B includes steps 302-332 that are substantially equivalent to the steps 202-232 of the flowchart 200 of FIGS. 2A-2B, respectively. It is also assumed that the house has defined a jackpot qualified hand that must be held as a final hand by a player (or players) in order to win the progressive jackpot. For purposes of example, it is assumed that the house defines the jackpot qualified hand to be any final hand comprising four-of-a-kind (or better). The method of flowchart 300 of FIGS. 3A-3B further includes variations and additional method steps (with respect to the method of the flowchart 200) as follows:

In step 302 (FIG. 3A), each player places an initial bet substantially as described above with respect to step 202 of the flowchart 200 of FIG. 2A. Additionally, each player electing to do so places a side bet into a progressive jackpot (that is separate and distinct from the cumulatively placed initial bet(s), first bet(s), etc.), thus establishing their preliminary eligibility to compete for the progressive jackpot. Typically, each of the side bets is of a mutually equal amount as defined by the house. Other embodiments using other side bet determination schemes can also be used. For purposes of an ongoing example, it is assumed that each of the side bets is in the amount of ten dollars.

Thereafter, steps 304-330 of the method 300 of FIGS. 3A-3B are performed substantially as described above with respect to steps 204-230 of the method 200 of FIGS. 2A-2B, respectively. Thus, one or more players place first, second and final bets, such that one or more players are defined to be final betting players (in step 322 of FIG. 3B), each holding a final hand. Any final betting player that has also placed a side bet (at step 302 above) is further defined to be a jackpot participating player. Also at steps 330 and 332, it is assumed that the house has paid any awards that are due to a final betting player or players in accordance with the payout schedule governing the present game, and that the house has taken possession of any and all bets placed by any non-winning, final betting players.

Then, in step 340 (FIG. 3B), the house evaluates the final hand held by each (if any) jackpot participating player to determine if any such final hand comprises a jackpot qualified hand. If no jackpot participating player holds a final hand that comprises a jackpot qualified hand, then the method 300 of FIGS. 3A-3B proceeds to step 342 below. If at least one jackpot participating player holds a jackpot qualified hand, then the method of the flowchart 300 proceeds to step 344 below. For purposes of the ongoing example, it is assumed that there are two jackpot participating players, of which a first jackpot participating player holds a final hand comprising pair of aces and a pair of sevens (i.e., two pair), while a second jackpot participating player holds a final hand comprising four kings (i.e., four-of-a-kind).

In step 342, the amount contained within the progressive jackpot is carried forward or "rolled over" for use in the next of a sequence of wagering games. In this way, the amount of the progressive jackpot typically grows (increases) with each successive wagering game until it is finally awarded to a jackpot participating player or players. In any case, the method of the flowchart 300 proceeds to step 346 below.

In step 344, the house awards the progressive jackpot to the jackpot participating player that holds the best (highest) jackpot qualified hand. In the ongoing example, it is assumed that the second jackpot participating player—holding a final hand comprising four-of-a-kind—is awarded the entire amount of the progressive jackpot. As such, the next successive wagering game (in a sequence of such games) would begin with an effectively "empty" progressive jackpot, until the first side bet or bets are placed therein (i.e., in step 302). In the event of a tie between jackpot qualified hands, the house can elect to split the progressive jackpot between such jackpot participating players evenly or in accordance with some other predetermined scheme.

In step 346, the method of the flowchart 300 of FIGS. 3A-3B is considered complete for the current instance of the wagering game of chance. The method of the flowchart 300 can be repeated in an iterative fashion thus defining a sequence of wagering games wherein, if desired, the same payout schedule and/or jackpot qualified hand can prevail (or be varied, respectively) during each successive game.

In this way, the method of the flowchart 300 provides at least one embodiment including a progressive jackpot as an inducement for player participation. In a typical embodiment, the house takes no portion of the progressive jackpot for itself such that the cumulative amount of the progressive jackpot is eventually awarded, in its entirety, to a jackpot participating player or players.

Variations of the general method of the flowchart 300 can also be used. For example, in some embodiments, the wagering game of chance includes a progressive jackpot that is increased during each game by transferring a portion (e.g., percentage, fixed amount, etc.) of the present cumulative total of the player(s) bets into the progressive jackpot, prior to (or after) the awarding of any amounts to the final betting players in accordance with the prevailing payout schedule. Thus, in such embodiments, players do not place a separate side bet into the progressive jackpot as is the case in step 302 (FIG. 3A) of the method of the flowchart 300. Rather, in such embodiments, the progressive jackpot is incrementally increased during each game by way of some portion of the cumulative total of the initial bet(s), first bet(s), final bet(s), etc. Other embodiments of the wagering game of chance, that include other progressive jackpot schemes, can also be used.

The various methods described above can also incorporate the use of "wild cards", such as jokers or other special cards as predefined by the house or in accordance with player consensus. For example, in one embodiment, the house offers two or more different payout schedules wherein one is elected to prevail during a game or sequence of games in accordance with player vote, etc. Other suitable variations can also be used.

As can be seen by the respective methods depicted in flowcharts 100 (FIG. 1), 200 (FIGS. 2A-2B) and 300 (FIGS. 3A-3B), one feature in accordance with the present embodiments is that play of the wagering game of chance amongst the players can be performed essentially simultaneously. That is, each time a fold or bet option is presented, all of the players can elect their respective options simultaneously, verses the sequential order of betting and/or folding as is typical to traditional card-based games (e.g., poker, etc.). This feature of certain embodiments provided for herein allows for generally faster play.

Furthermore, because the players are generally playing against the payout schedule (in essence, against the house), the present embodiments provide for a poker-type wagering game that generally fosters a friendly, non-competitive atmosphere that is similar to that of blackjack (twenty-one). Of course, there is player-to-player competition in regard to any progressive jackpot that may be included within a particular embodiment, but such competitive participation is typically optional and distinctly separate with respect to the main play of the wagering game of chance. Another feature of the various embodiments provided for herein is that the house generally derives its share (profit) from the cumulative total of the players respective bets, minus that amount that is effectively awarded to a player or players in accordance with the prevailing payout schedule. Such a scheme enables the house to effectively predetermine its typical (or average) earnings by way of establishing minimum and/or fixed betting amounts, establishing one or more payout schedules in accordance with the probabilistic likelihood of each of the final hands listed thereon, etc.

Figure 4:
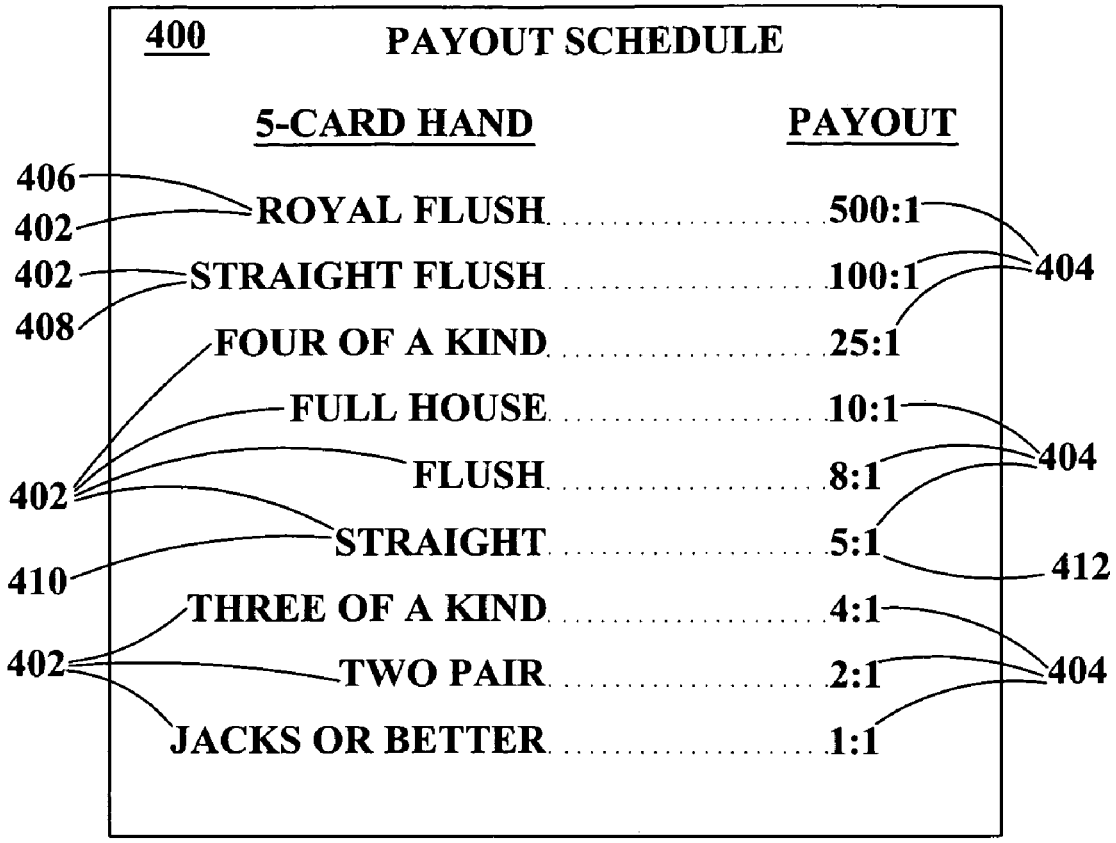
FIG. 4 is an exemplary payout schedule in accordance with another embodiment.

FIG. 4 depicts an exemplary payout schedule 400 in accordance with another embodiment. The exemplary payout schedule 400 includes a plurality of card hands 402. As depicted in FIG. 4, the card hands 402 are arranged in descending order (down the page) in accordance with a predetermined (i.e., traditional, or conventional) ranking of five-card poker hands. Thus, as depicted in FIG. 4, the ROYAL FLUSH 406 is of higher rank than the STRAIGHT FLUSH 408, etc. One of skill in the poker gaming arts is aware of such card hand 402 definitions and further elaboration is not required for purposes herein. In any case, other payout schedules (not shown) including card hands 402 arranged under other methodologies, or in accordance with other respective full-hand card counts, can also be used.

Each of the card hands 402 corresponds to an individual payout multiplier or ratio (hereafter, multiplier) 404. As depicted in FIG. 4, each multiplier 404 is provided as a ratio describing the number of payout units (e.g., dollars, etc.) to be awarded per unit bet. For example, the STRAIGHT 410 corresponds to a multiplier 412 calling for a 5:1 (i.e., five-to-one) payout for any final betting player holding a final hand that comprises a "straight". As such, any final betting player holding a final hand comprising a "straight" would be awarded an amount equal to five times their total cumulative bet during a present instance of the wagering game governed by the exemplary payout schedule 400. Other payout schedules (not shown) can be defined and used wherein each multiplier 404 is provided in a different format.

As depicted in FIG. 4, each multiplier 404 is provided as a whole-number ratio in the interest of clarity of understanding. However, it is to be understood that other multipliers 404 (not shown) can be defined and used wherein each multiplier 404 is not necessarily a whole-number ratio (or factor). For example, a payout schedule (not shown) can be defined and used providing a multiplier 404 in the ratio of 3.5:2—that is, calling for a payout of three-and-a-half units (e.g., dollars, etc.) per two units of the corresponding cumulative bet.

Generally, various embodiments of payout schedule can be defined and used in accordance with the present invention that provide for a respectively fixed set of final hands and their corresponding award amounts. It is to be understood that the exemplary payout schedule 400 of FIG. 4 depicts just one of any number of such possible payout schedules in accordance with the inventive principles provided herein.

Figure 5:
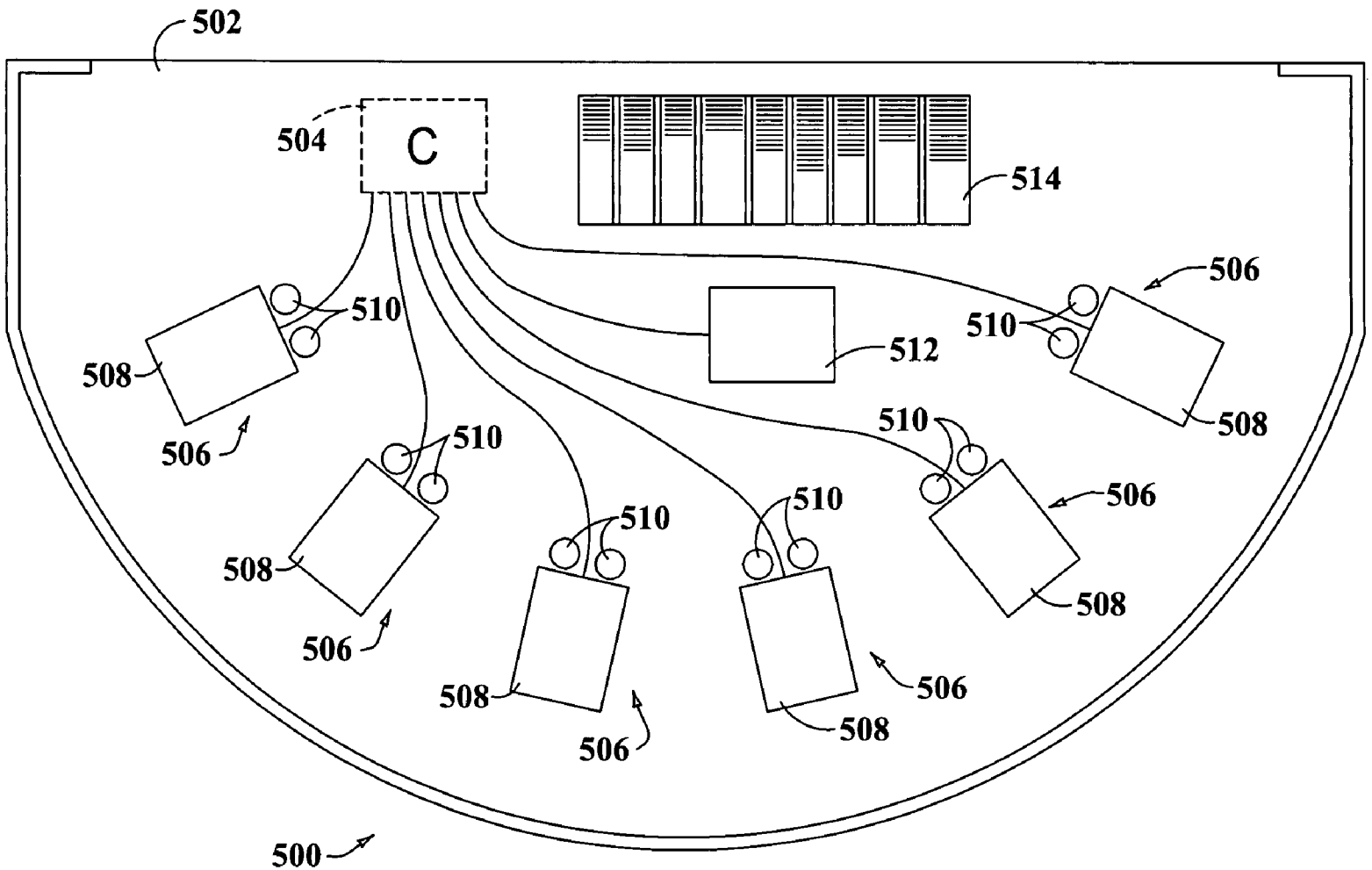
FIG. 5 is a plan view depicting a wager gaming table in accordance with yet another embodiment.

FIG. 5 is a plan view depicting a wager gaming table (hereafter, table) 500 in accordance with still another embodiment. The terms "wager gaming table", "gaming table" and "table" are used interchangeably herein. The wager gaming table 500, substantially as depicted in FIG. 5, is commercially available from DigiDeal Corporation of Spokane, Wash. The table 500 includes a playing surface 502. The playing surface 502 can be formed from any suitable material such as, for example, felt, satin, etc. Other materials can also be used to form the playing surface 502 of the table 500.

The table 500 also includes an electronic controller 504. The electronic controller 504 can be defined by any suitable controller usable to control the play of one or more embodiments of the wagering game(s) of chance of provided for herein (e.g., the methods of the flowcharts 100, 200 and/or 300 above, or any suitable corresponding variations, respectively). As such, the controller 504 can be suitably defined by a microprocessor-based controller, a state-machine, a dedicated-purpose integrated controller, etc. The controller 504 is commercially available in the form of a proprietary (DCS) platform from DigiDeal Corporation of Spokane, Wash.

In one embodiment, the electronic controller 504 includes a computer-accessible storage media (i.e., memory, storage disk, etc., not shown) including an executable program code. Such an executable program code (not shown) is configured to cause a corresponding processor to perform various operations in accordance with one or more embodiments of a wagering game of chance as provided for herein. One of skill in the computer engineering and electronic arts can appreciate that the electronic controller 504 can be defined by a number of suitable different embodiments, and that further elaboration is not required for purposes of understanding the presently described embodiment.

The table 500 also includes a plurality of user interfaces 506. Each user interface 506 is coupled in signal communication with the electronic controller 504. Each user interface 506 includes an electronic display 508 that is coupled in signal communication with the electronic controller 504. In certain embodiments, the electronic display 508 can be a touch-sensitive electronic display. Other embodiments of electronic display 508 can also be used. In any case, the electronic displays 508 are configured to display information to, and optionally receive input from, a player during play of a wagering game of chance at the table 500. Non-limiting examples of such displayed information include images of playing cards, present amount of a progressive jackpot, amount of a currently placed bet for a corresponding player, cumulative amount wagered during a game for a corresponding player, the prevailing payout schedule itself, etc. Examples of player (i.e., user) input include selection of cards to discard during dealing of an initial hand, election to bet or fold, designation of the amount of a respective bet, etc., in accordance with the rules of the present game and/or other aspects of play described below. Other kinds of information can be displayed, and other types of player input received, by way of the electronic display 508.

As further depicted in FIG. 5, each user interface 506 further includes one or more chip sensors 510. Each chip sensor 510 is configured to provide a signal to the electronic controller 504 indicative of the presence and/or total face value of any wagering chips (not shown) resting upon the chip sensor 510. One of skill in the electronic arts is aware of a number of suitable such embodiments of chip sensor 510 and further description is not needed for purposes herein.

In another embodiment of the table 500 (not shown), the chip sensors 510 are not included. In such an embodiment (not shown), "virtual" chips can be displayed to, and manipulated by (i.e., selected, put forth during a wager, etc.), players using associated electronic displays 508. Thus, in such an embodiment, tangible wagering chips are not used, and any wagering and/or awards corresponding to play of the present wagering game of chance are handled by way of the electronic displays 508.

The table 500 can also include a dealer display 512, although in some embodiments no dealer display is used. The dealer display 512 can be defined by any suitable electronic display for displaying information to a dealer (typically representing the house). In one embodiment, the display 512 is substantially the same as one of the plurality of electronic displays 508. Other forms of electronic display and/or dealer interface (not shown) can also be used. In any event, the dealer display 512 is coupled in signal communication with the electronic controller 504 and is configured to display information to and receive input from a dealer (typically representing the house) during play of the wagering game at the table 500.

Typically such information displayed on the dealer display 512 can include, for example, the amount of a present progressive jackpot, identification of a player or players at the table 500 in possession of (i.e., holding) a final hand corresponding to an award provided by the prevailing payout schedule, the prevailing payout schedule itself, any jackpot qualifying hands, etc. Information provided to the dealer can be presented, for example, in the form of a "wager meter", an "overall jackpot meter", a digital numeric display, etc., or as any other desirable graphical representation.

The table 500 further includes a chip tray 514. The chip tray 514 is configured to support a plurality of suitable wagering chips for use during play of the wagering game of chance at the table 500. The chip tray 514 is generally positioned to be readily used by a dealer. A more elaborate description of the chip tray 514 is not necessary to an understanding of the present embodiments provided for herein. In the variation described above wherein "virtual" chips can be used with the table 500, the chip tray can be eliminated.

Typical use of the table 500 is a follows: to begin, it is assumed that the house offers play of a wagering game of chance in accordance with any of the present embodiments provided for herein (e.g., according to the method of the flowchart 100 of FIG. 1, the method of the flowchart 200 of FIGS. 2A-2B, or the method of the flowchart 300 of FIGS. 3A-3B, etc.) to interested players by way of the table 500. Those players interested in playing the wagering game of chance generally seat themselves, one person each, within usable adjacency to the user interfaces 506. As depicted in FIG. 5, the table 500 can accommodate up to six players. Other tables 500 (not shown) having other player accommodation capacities can also be used.

Next, a dealer begins play of the instant game at the table 500 by way of appropriate input (i.e., password entry, startup actuation, etc.) to the controller 504 using dealer hands controls (such as buttons, etc., not shown) or, if provided, the dealer display 512. Thereafter, the controller 504 assumes general control of the game in substantial accordance with the methods described above in regard to the wagering game of chance of the flowchart 100 of FIG. 1, the flowchart 200 of FIGS. 2A-2B, of the flowchart 300 of FIGS. 3A-3B, or any of their respective variations or derivatives, including, for example, providing graphical displays of cards, value of the cumulative player wagers, present value of a progressive jackpot, etc., to each of the electronic displays 508 currently used by a player. In response, players provide their desired respective inputs directly to the dealer who can then input them into the electronic controller 504 or, if such capability is provided, directly to the electronic controller 504 via their respective electronic displays 508. Such displays and player inputs (if provided) are performed in accordance with the currently used embodiments of wagering games of chance provided for herein.

During such play, the players place their corresponding bets in the form of wagering chips on their respective chip sensors 510. These wagering chips are collected for the house by the dealer, generally into the chip tray 514, while the electronic controller 504 can keep track of (i.e., register, or record) the total of each players discrete bets (initial, first, second, final, etc.), the valid or folded status of each player, the present value of a progressive jackpot (if any), cards selectively discarded from preliminary hands during the establishment of initial hands, etc. In various alternate configurations certain of these functions (e.g., accounting for the bets, etc.) can be performed by a live dealer and not by the controller 504. Furthermore, the electronic controller 504 can determine (i.e., identify) and indicate to the dealer and/or players (by way of the electronic displays 508 and/or dealer display 512) when a player or players is/are to be awarded a respective amount in accordance with the prevailing (presently applicable or governing) payout schedule, or if a player or players is/are to be awarded/split any progressive jackpot or other award that may apply, in accordance with the wagering game of chance in progress.

Other operations can also be performed by the electronic controller 504 corresponding to the play and/or officiating of the current instance of the game of the embodiments provided for herein. For example, in an embodiment (not shown) of the table 500 in which tangible chips are not used, the electronic controller 504 receives (registers) bets, and awards amounts and/or a progressive jackpot, etc., through the use of virtual chips (i.e., credits) displayed and manipulated on the electronic displays 508. Still other operations of the electronic controller 504 can be performed. For example, the controller 504 can be used to provide audio output for informational purposes, enhancing excitement of the play of the game, or supplementing visual play of the game. In this way, the table 500 provides for play of one or more variations of the wagering game of chance (selectively), by two or more players, in accordance with the embodiments provided for herein and in a manner that is substantially automated by virtue of the electronic controller 504, the user interfaces 506 and the dealer display 512 (when provided).

It is to be understood that certain embodiments of the controller 504 can be linked in communication with a central computer or database (not shown) of the house so that information regarding the present status of the wagering game of chance in progress can be related to the central computer. Thus, for example, the current value of the total player(s) wagers, the total amount of credit in use, the current awarding of a progressive jackpot (or portion thereof), the total bets placed on a per-player basis, etc., for the table 500 can be recorded and/or verified for security purposes using the central computer (not shown). Further exemplary use of the table 500 of FIG. 5 is explained hereinafter in regard to FIGS. 7A-7D.

Figure 6:
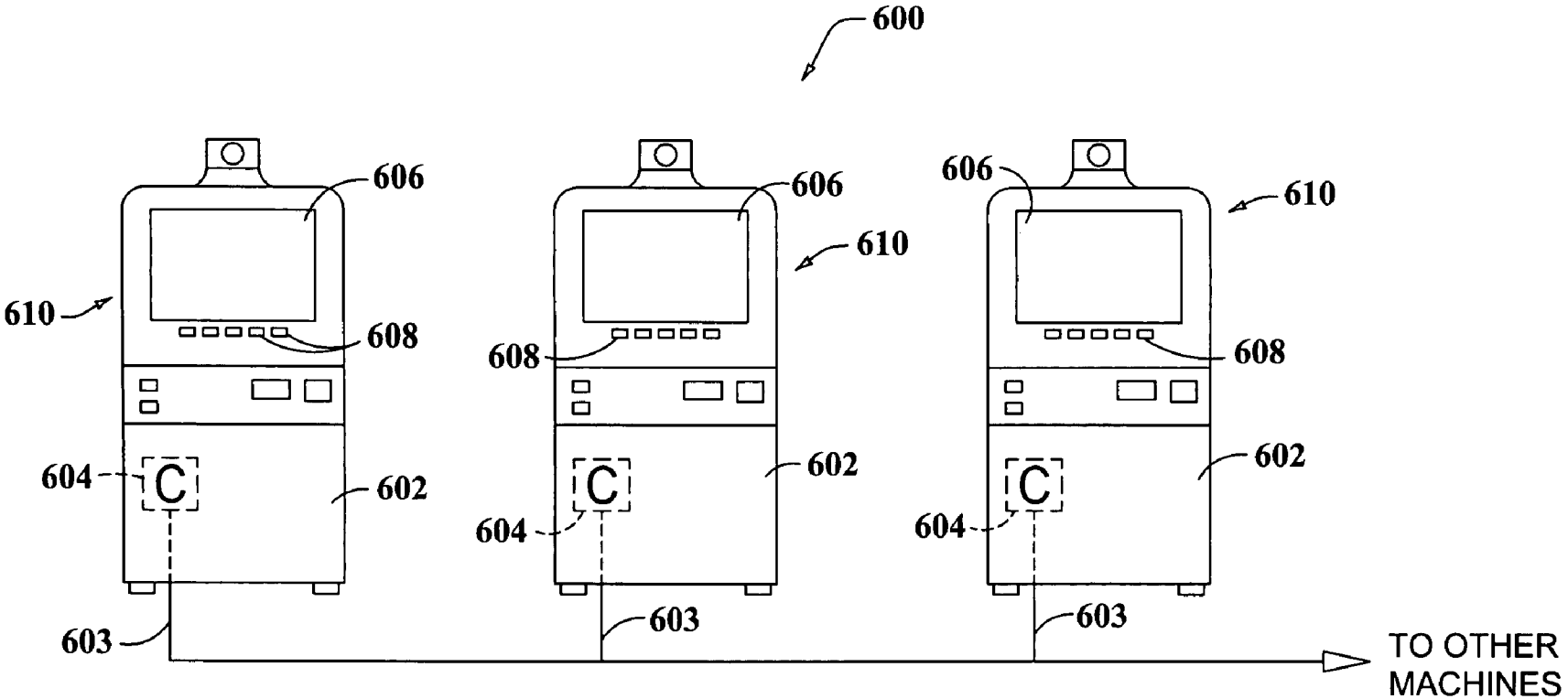
FIG. 6 is front elevation view depicting a gaming network in accordance with another embodiment.

FIG. 6 is a front elevation view depicting a gaming network 600 in accordance with the yet another embodiment. The gaming network 600 includes a plurality of individual gaming machines (hereafter, gaming machine) 602. Each gaming machine 602 includes an electronic controller 604. The electronic controller 604 can be defined by any suitable electronic controller usable to control the gaming machine 602 in accordance with one or more embodiments of a wagering game of chance of as provided for herein (e.g., the method of the flowchart 100 of FIG. 1, the method of the flowchart 200 of FIG. 2A-2B, the method of the flowchart 300 of FIGS. 3A-3B, and/or any respective variations thereon).

In one embodiment (not shown), the controller 604 includes a processor and a computer-accessible storage media including an executable program code. The executable program code (not shown) is configured to cause the processor to perform numerous operations in accordance with one or more embodiments of the wagering games of chance provided for herein. Other forms of electronic controller 604 can also be used. In any case, each of the electronic controllers 604 is configured to be coupled in mutual data communication thus defining a network of gaming machines 602. In this way, the electronic controllers 604 can communicate with each other so as to conduct a multi-player instance of a wagering game of chance of the embodiments provided for herein, wherein each player participates in the game by way of a respective gaming machine 602. Although the gaming machines 602 are depicted as being directly connected to one another by communication cables 603, it is appreciated that the gaming machines 602 can be placed in communication by other known means such as the Internet or other network configurations. In another embodiment (not shown), the individual gaming machines 602 are networked by way of wireless communication. Other embodiments can also be used.

Each gaming machine 602 also includes an electronic display 606. Each electronic display 606 is coupled in signal communication with the corresponding electronic controller 604 of the particular gaming machine 602. Each electronic display 606 can be defined by any suitable such electronic display configured to display various kinds of information in accordance with the present instance of a wagering game of chance of the embodiments provided for herein. Such displayed information can include, for example, images of playing cards, present amount of the cumulative bets (wagers), any applicable progressive jackpot amount, total cumulative bet placed by a corresponding player during the course of the wagering game, amount of an award to a player for a qualifying final hand, display of the prevailing payout schedule, etc. Other suitable information can also be displayed. Typically, each electronic display 606 is defined by a touch-sensitive electronic display such that each constitutes a user (player) interface to the respective electronic controller 604. Other forms of electronic display 606 can also be used as well as other user input devices (such as buttons, keys, light pens, etc. not shown).

Each gaming machine 602 can (optionally) include additional user interface controls 608. Controls 608 are typically provided in the form of pushbuttons. Other types of user interface controls 608 can also be used. The electronic display 606 and controls 608 are collectively referred to as a user interface 610 within a particular gaming machine 602.

Operation of the gaming network 600 is generally as follows: for purposes of example, it is initially assumed that all of the gaming machines 602 of the gaming network 600 are presently configured (selectively set) to play one or more embodiment (version, or type) of a wagering game of chance of as provided for herein, for example in accordance with the method of the flowchart 200 of FIGS. 2A-2B.

Next, each player deposits money into their respective gaming machine 602 so as to establish a corresponding amount of playable credit, referred to herein as prepaid credits. This can be done, for example, by way of a conventional currency acceptor (not shown) as is known in the art. The wagering game of chance then commences once all of a predetermined number of players have secured their respective gaming credits. For purposes of example, it is assumed that a game includes an initial count of four players, each participating by way of a respective gaming machine 602.

Thereafter, the electronic controllers 604 operate in cooperation with each other and with their respective user interfaces 610 so as to carry out play of the current wagering game. Generally, play is conducted as a succession (sequence) of such wagering games of chance. Furthermore, such a succession of games can continue until a progressive jackpot (if any) has been awarded. Furthermore, any other applicable awards (in accordance with the prevailing payout schedule) are also provided during play under the control of the electronic controller(s) 604. Typically, individual players can exit (depart from) the game at any appropriate time of their choosing (e.g., at the beginning of the next game, after folding, etc.), while other (new) players can join at correspondingly appropriate times by way of associated gaming machines 602 of the gaming network 600.

Thus, the gaming network 600 is generally configured to provide for multi-user, substantially random-access (i.e., individually selected entry to and exit from) play of a wagering game of chance of the embodiments provided for herein. In another embodiment of the gaming network 600, each of the electronic controllers 604 is configured to permit a player to select from a menu of different variations of the wagering games of provided for herein (various betting amounts or schemes, inclusion of the selection of an initial hand from a preliminary hand, etc.) to play against other corresponding players within the same gaming network 600.

For example, a gaming network 600 can be provided that includes ten gaming machines 602, of which four are presently being used to play one or more embodiments of a wagering game of chance as provided for herein, while the remaining six are used to play another embodiment of a wagering game herein. Other possible such game playing combinations within a single gaming network 600 can also be performed.

In yet another embodiment, the controller 604 of each gaming machine 602 is configured to permit a player to selectively choose to play a wagering game of chance of the embodiments provided for herein in a solitaire or "individual play" mode. In such an embodiment, the player is effectively playing against the controller 604 (i.e., in accordance with the prevailing payout schedule), wherein there is essentially no competition against other players (such as, for example, in the case of progressive jackpot that is being funded by way of the side bets of multiple players). Other various embodiments of playing wagering games of chance as provided for herein can also be used. Further exemplary use of the gaming network 600 is explained hereinafter in regard to the exemplary displays of FIGS. 7A-7D.

Figure 7A:
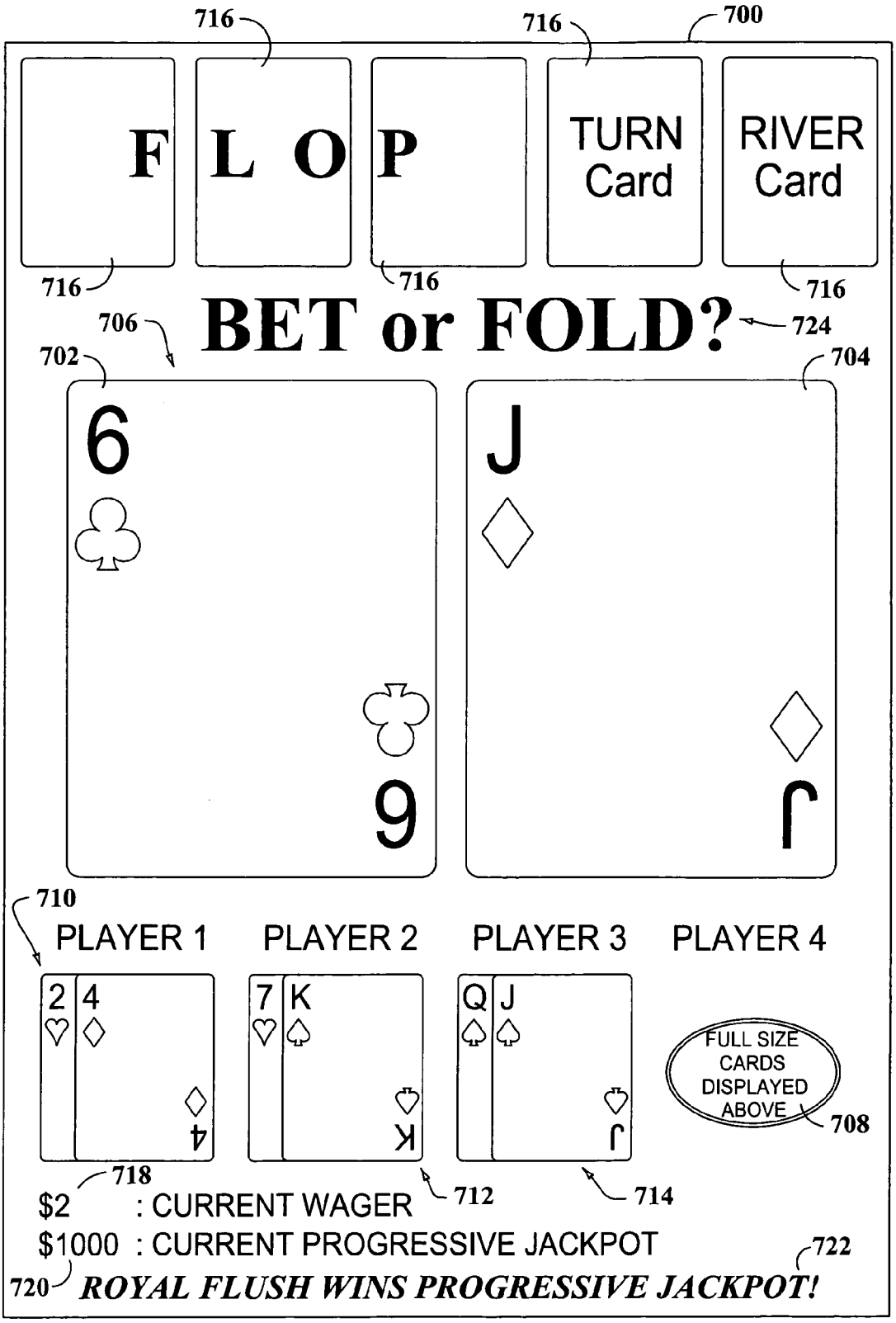
FIG. 7A is a front elevation view depicting an exemplary display in accordance with still another embodiment.

FIG. 7A is a front elevation view depicting an exemplary display 700 in accordance with still another embodiment. The display 700 can be provided by way of the electronic displays 508 of the table 500 of FIG. 5, by way of the electronic displays 606 of the gaming machines 602 of FIG. 6, or by any other suitable means (not shown). It is to be understood that the display 700 is intended to show exemplary details that are provided to a player during typical automated play of a wagering game of chance of the embodiments provided for herein, and that other details (not shown) can also be displayed. Alternatively, certain details as depicted in the display 700 of FIGS. 7A-7D can also be omitted in particular embodiments of a wagering game of chance as provided for herein. For purposes of example, it is assumed that the display 700 includes information typically displayed during a four player version of the wagering game of chance of the method of flowchart 300 of FIGS. 3A-3B above, wherein a progressive jackpot is included as a part of the present game. Other displays (not shown) including and/or excluding certain information and images (as described hereinafter) can also be used in accordance with other embodiments provided for herein.

The display 700 of FIG. 7A includes a pair of card images (hereinafter, cards) 702 and 704, respectively. The cards 702 and 704 collectively define an initial hand 706 for a particular player designated as Player 4, as indicated in conjunction with a "DISPLAYED ABOVE" icon 708. Also included in the display 700 are initials hands 710, 712 and 714 corresponding to a Player 1, Player 2 and Player 3, respectively. Furthermore, the display 700 of FIG. 7A includes five placeholders 716 indicating the respective future locations of three "flop" cards, one "turn" card, and one "river" card that are as yet to be dealt during the course of the present wagering game of chance.

The display 700 of FIG. 7A also includes a wager value 718 representing the cumulative wager placed by player 4 during the present instance of the wagering game of chance. As depicted by FIG. 7A, Player 4 has placed a total wager (thus far in the present game) of two dollars, corresponding to an initial bet of that same value. The display 700 of FIG. 7A further includes a progressive jackpot value 720 represent the current amount of that prize (award), as well as an advisory line 722 indicating that the jackpot qualified hand for the present game is defined by a royal flush (as predetermined by the house). Other advisory lines (not shown) corresponding to another jackpot qualified hand such as, for example, a straight flush (or better), can also be used.

Figure 7B:
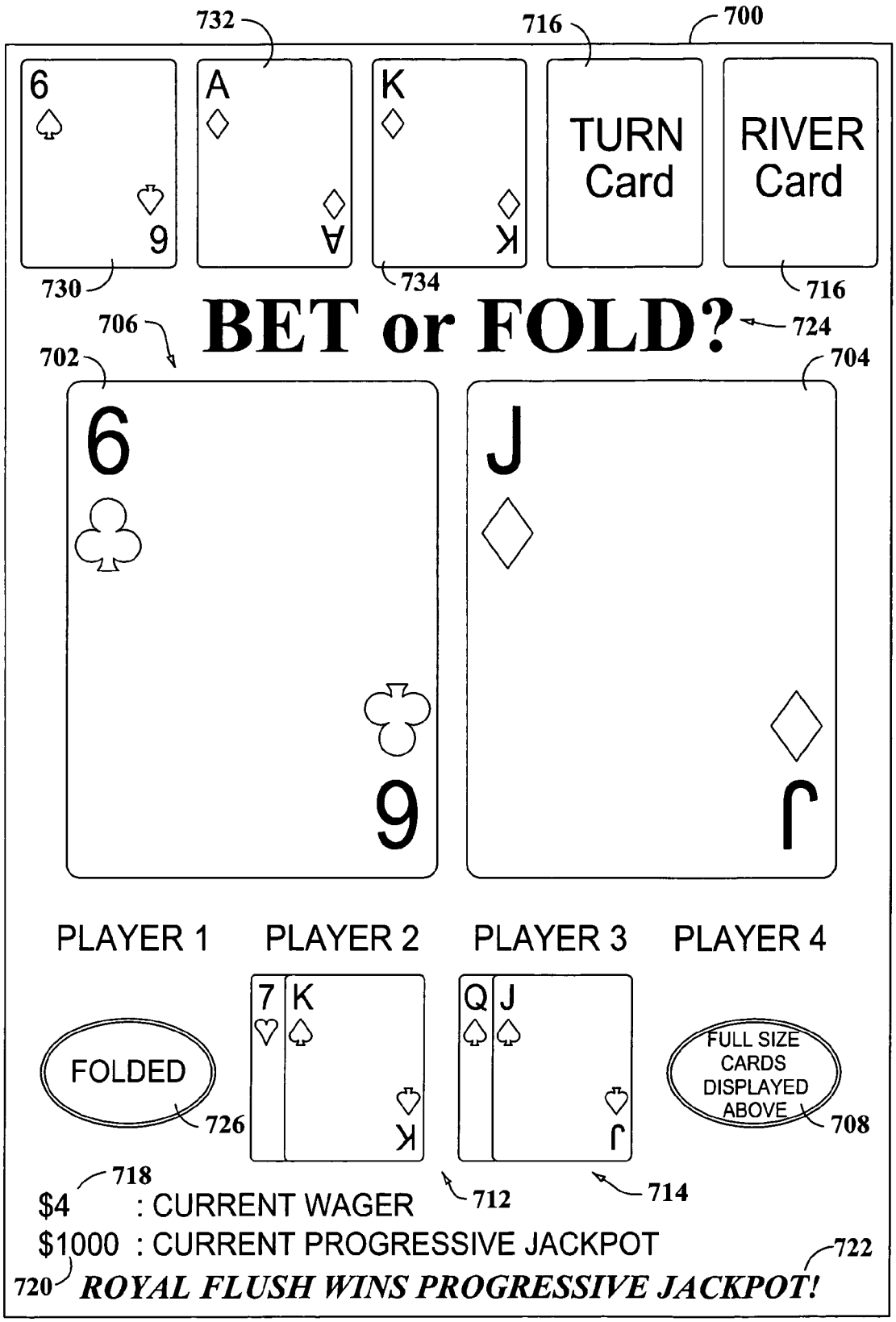
FIG. 7B is a sequential continuation of the exemplary display of FIG. 7A.

Furthermore, the display 700 includes a query line 724. As depicted in FIG. 7A, the query line 724 instructs Player 4 to provide input corresponding to placing a first bet, or folding at this time and quitting the game. Other query lines (not shown) can also be provided in accordance with the present embodiment and/or status of the wagering game in progress. For purposes of ongoing example, it is assumed that Player 2, Player 3 and Player 4 respectively elect to place a first bet (of two dollars each) and continue play of the game, while Player 1 elects to fold. Reference is now directed to FIG. 7B.

Figure 7C:
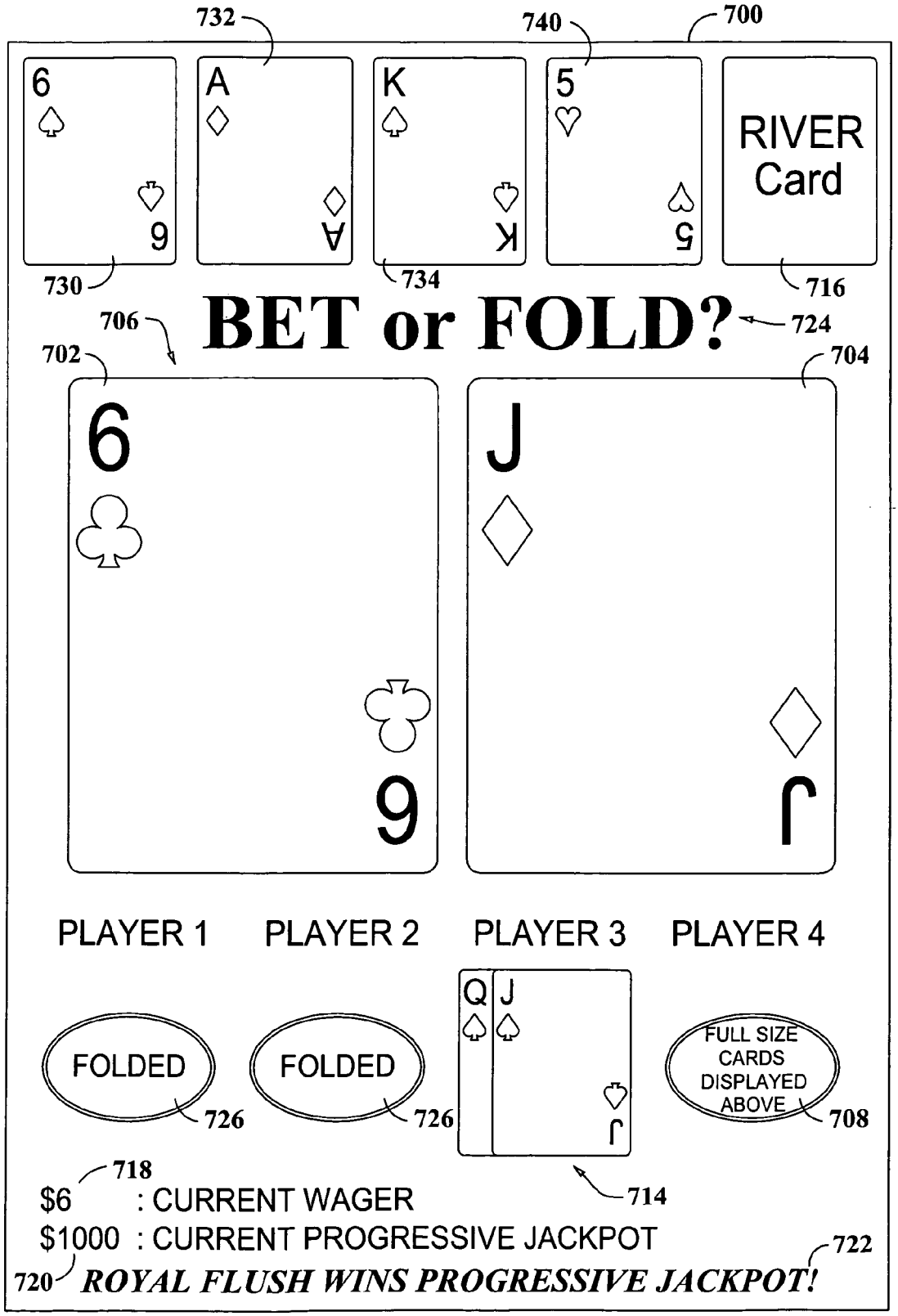
FIG. 7C is a sequential continuation of the exemplary display of FIG. 7B.

FIG. 7B is a sequential continuation of the display 700 of FIG. 7A. The display 700 as depicted in FIG. 7B includes the same elements 702-724 as described above in regard to the display 700 of FIG. 7A, with the following changes and/or additions: the initial hand 710 of Player 1 has been replaced with a "FOLDED" icon 726; the wager value 718 of Player 4 has increased by two dollars in accordance with the first bet (i.e., now four dollars total); and the placeholders 716 representing the future location of three "flop" cards have been replaced by three "flop" card images 730, 732 and 734, respectively. At this point, each of the remaining valid players (i.e., Players 2, 3 and 4) must decide whether to place a second bet or fold. For purposes of the ongoing example, it is assumed that Player 2 elects to fold at this time, while Player 3 and Player 4 each elect to place a second bet (of two dollars each) and continue play of the game. Reference is now directed to FIG. 7C.

Figure 7D:
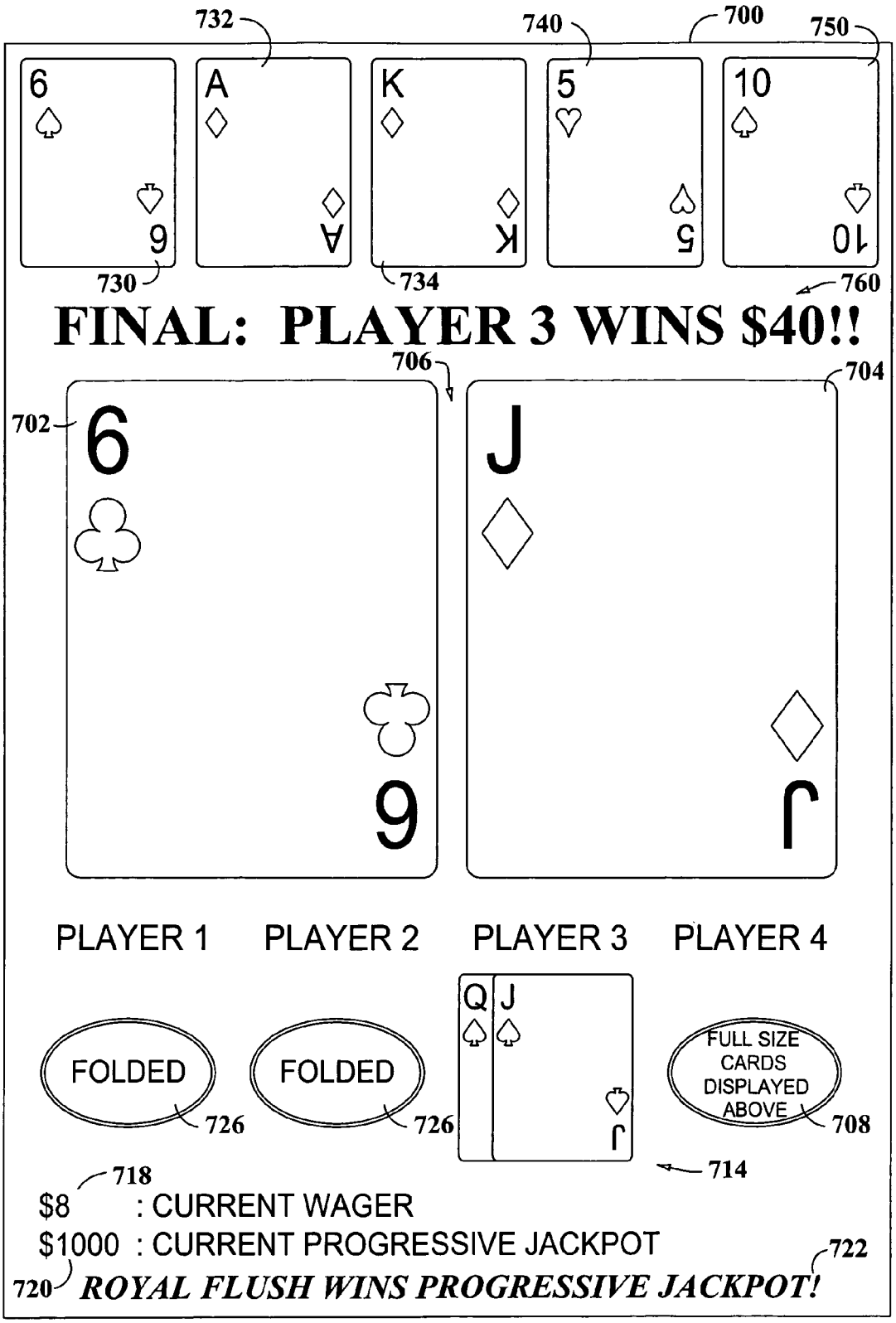
FIG. 7D is a sequential continuation of the exemplary display of FIG. 7C.

FIG. 7C is a sequential continuation of the display 700 of FIG. 7B. The display 700 as depicted in FIG. 7C includes the same elements 702-734 as described above in regard to the display 700 of FIG. 7B, with the following changes and/or additions: the initial hand 712 of Player 2 has been replaced with a "FOLDED" icon 726; the wager value 718 of Player 4 has increased by two dollars in accordance with the second bet (i.e., now six dollars total); and the placeholder 716 representing the future location of the "turn" card has been replaced by a "turn" card image 740. At this time, each of the valid players (i.e., Players 3 and 4) must decide whether to place a final bet or fold. For purposes of the ongoing example, it is assumed that both Player 3 and Player 4 elect to place a final bet (of two dollars each) and continue play of the game. Reference is now directed to FIG. 7D.

FIG. 7D is a sequential continuation of the display 700 of FIG. 7C. The display 700 as depicted in FIG. 7D includes the same elements 702-740 as described above in regard to the display 700 of FIG. 7C, with the following changes and/or additions: the placeholder 716 representing the future location of the "river" card has been replaced by a "river" card image 750; the wager value 718 of Player 4 has increased by two dollars in accordance with the final bet (i.e., now eight dollars total), wherein the wager value 718 is now indicated to be a final total; and the query line 722 has been replaced with an award notification 760 indicating that Player 3 has been awarded forty dollars (in accordance with the prevailing payout schedule). As depicted in FIG. 7D, Player 3 has been awarded forty dollars for holding a final hand comprising a straight (i.e., five cards of sequential ranking, A-K-Q-J-10, in varying suits). For purposes of the present example, it is assumed that Player 3 placed a total cumulative wager (not counting any possible side bet to the progressive jackpot) of eight dollars during the present wagering game, wherein the prevailing payout schedule calls for a 5:1 (five-to-one) payout (multiplier) for such a final hand (a straight). As further depicted in FIG. 7, Player 4 failed to achieve (hold) a final hand corresponding to any sort of award according to the prevailing payout schedule.

At this point, the present instance of the wagering game of chance as depicted in FIGS. 7A-7D is considered complete. Furthermore, it is assumed that the progressive jackpot value 720 of one thousand dollars is "rolled over" (carried forward) as the starting progressive jackpot value for any future play of the same embodiments of the wagering game of chance. Such future plays can include, for example, maintaining or redefining the payout schedule, addition of player-elected side bets into the progressive jackpot, redefinition of the jackpot qualified hand, and can include different and/or a new number of players, etc., in accordance with the principles of the embodiments provided for herein. Other embodiments and variations of the wagering game of chance can also be played in accordance with embodiments provided for herein, using displays (not shown) of information that are correspondingly consistent and/or varied from those depicted in FIGS. 7A-7D.

Figure 8:
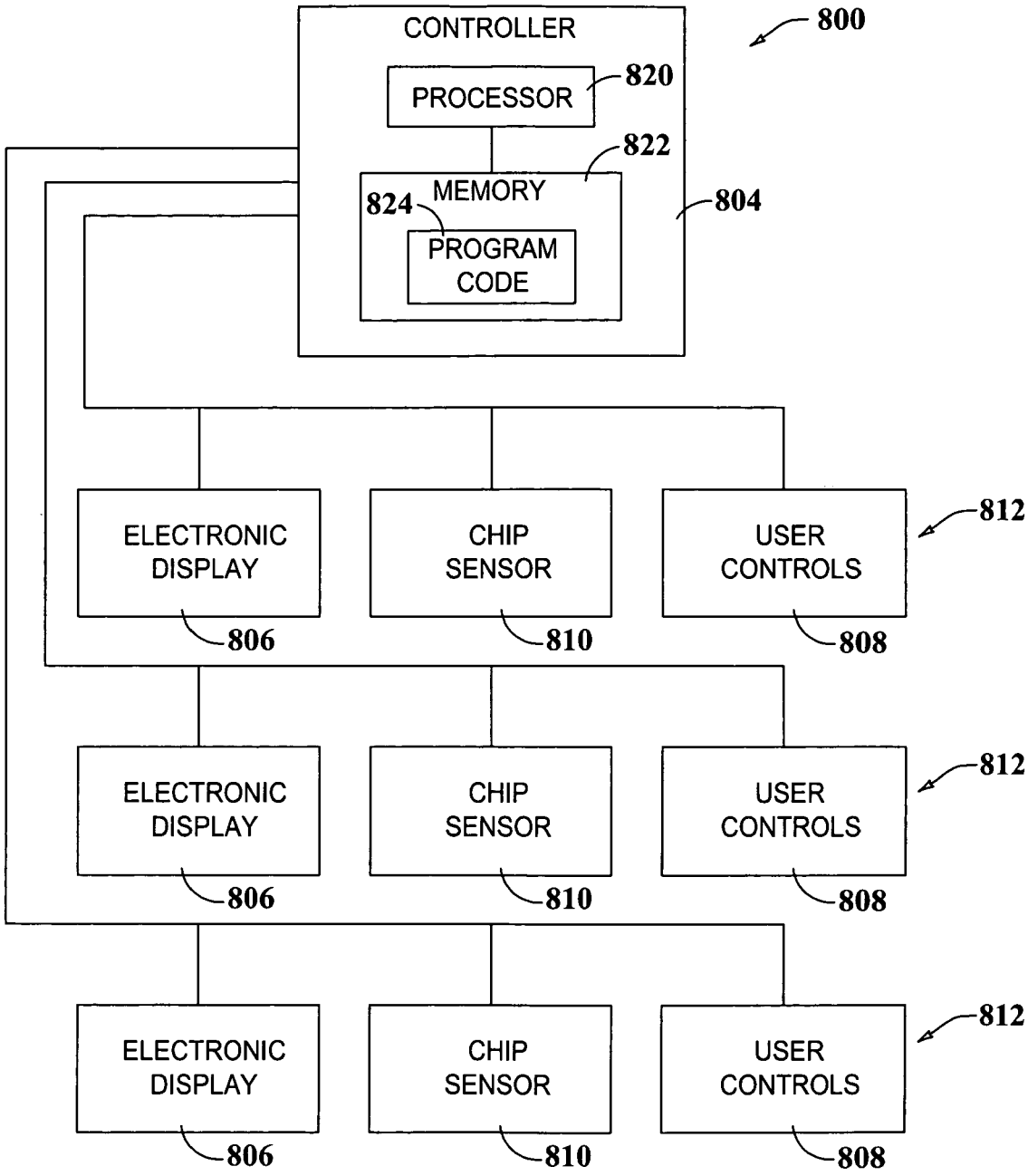
FIG. 8 is a block diagram depicting a control system in accordance with still another embodiment.

FIG. 8 is block diagram depicting a control system 800 in accordance with another embodiment. The control system 800 includes an electronic controller 804, which in turn includes a processor 820. The processor 820 can be defined by any microprocessor or microcontroller suitable for use with the present embodiment. One of skill in the embedded control or electrical engineering arts is aware of numerous such processors 800 and further elaboration is not needed for an understanding of the present embodiment.

The controller 800 also includes a memory 822. The memory 822 is coupled in data communication with the processor 820. The memory 822 can be defined by any suitable computer-accessible storage media such as RAM-type memory, ROM-type memory, EPROM-type memory, etc. Other types of suitable memory 822 can also be used. In any case, the memory 822 is configured to cooperate with the processor 820 during normal operation of the control system 800. The memory 822 can store a payout schedule, such as schedule 400 of FIG. 4.

The memory 822 includes a program code 824. The program code 824 is configured to cause the processor 820 to execute method steps (i.e., instructions) in accordance with one or more embodiments of a wagering game as provided for herein. For example, the program code 824 can be defined so as to cause the processor 820 to execute steps in accordance with the method of the flowchart 100 of FIG. 1, the method of the flowchart 200 of FIGS. 2A-2B, and/or the method of the flowchart 300 of FIGS. 3A-3B, or any suitably varying embodiments thereof, respectively. Other program codes 824 corresponding to other embodiments (i.e., wagering games of chance) as provided for herein can also be used. The program code 824 can be further configured to cause the processor 820 to perform other related or auxiliary functions, such as communication with a centralized computer (not shown), communication and/or cooperation with other control systems 800, etc. In one or more embodiments of the control system 800, the program code 824 is provided by way of a computer-accessible storage media such as a CD-ROM, magnetic disk or disks, magnetic tape, etc., and copied or moved into the memory 822. In this manner, for example, the program code 824 of the memory 822 can be readily updated as new versions of the program code 824 become available, or reloaded in the event that the contents of memory 822 become corrupted, etc.

As depicted in FIG. 8, the control system 800 includes a plurality of user interfaces 812 that are coupled in data communication with the electronic controller 804. In the interest of example, a total of three user interfaces 812 are depicted in FIG. 8. However, it is to be understood that any suitable number of such user interfaces 812 can be used in accordance with a corresponding embodiment of the control system 800. Each user interface 812 includes an electronic display 806, a chip sensor 810 and a set of user controls 808. Each electronic display 806, chip sensor 810, and user controls 808 can be respectively defined by any such embodiments suitable for use with other embodiments provided for herein. For example, each of the electronic displays 806 and chip sensors 810 can be respectively defined substantially as described above in regard to the electronic displays 508 and the chip sensors 510 of the wager gaming table 500 of FIG. 5. In a further example, each of the user controls 808 can be substantially defined as described above in regard to the user interface controls 608 of the gaming machines 602 of FIG. 6. Other suitable definitions of the electronic display 806, chip sensor 810 and user controls 808 of each user interface 812 can also be used.

The control system 800 of FIG. 8 can be defined as desired so as to perform numerous functions in accordance with playing a wagering game of chance of the embodiments provided for herein in a substantially automated venue. Thus, various embodiments of the control system 800 of FIG. 8 can be suitably defined so as to provide for the controller 504 and user interfaces 506 of the table 500 of FIG. 5. Similarly, other embodiments of the control system 800 of FIG. 8 can be suitably defined so as to provide for the controller 604 and user interface 610 of each gaming machine 602 of FIG. 6.

Figure 9A:
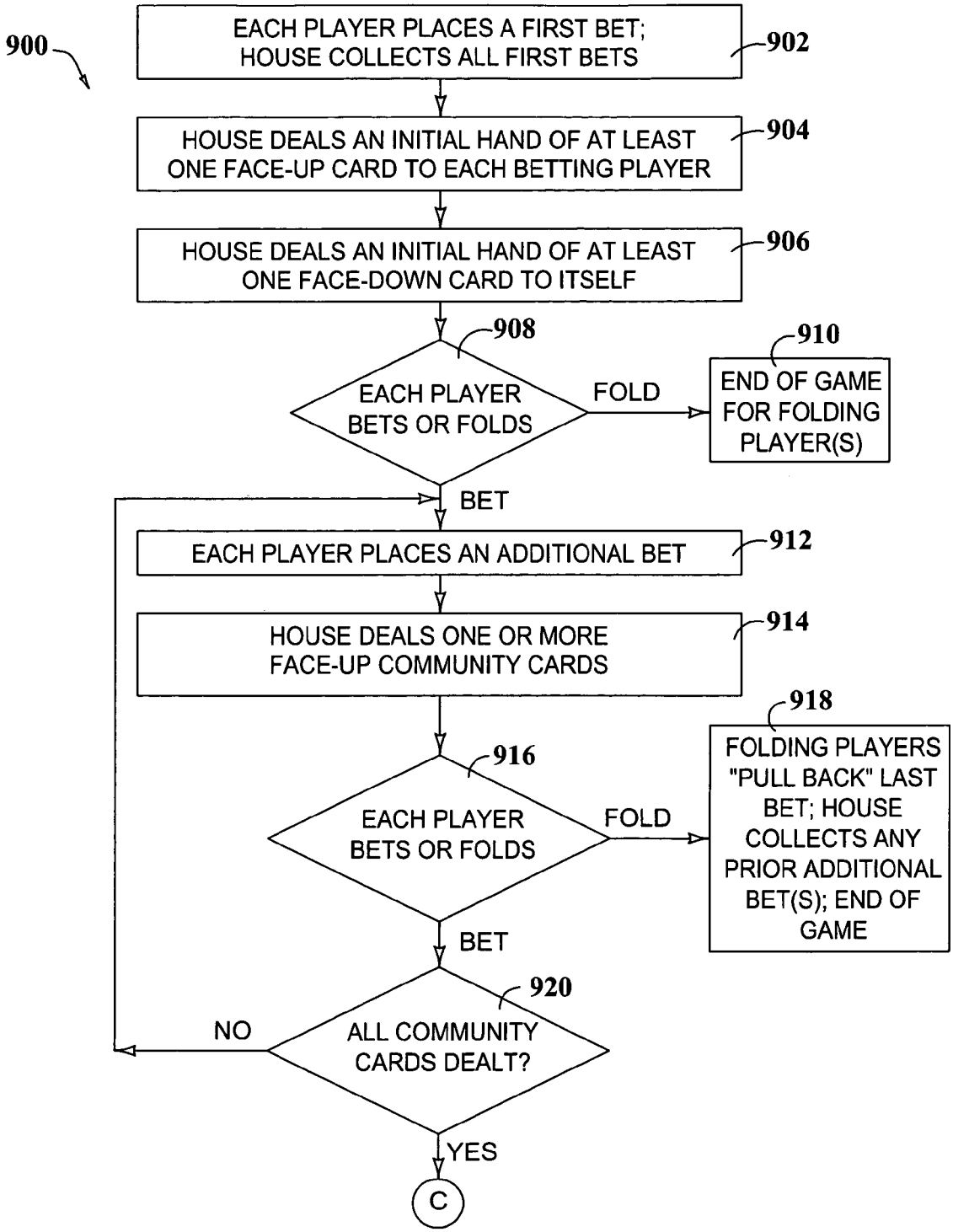
FIG. 9A is a flowchart depicting a method of playing a wagering game of chance in accordance with another embodiment.
Figure 9B:
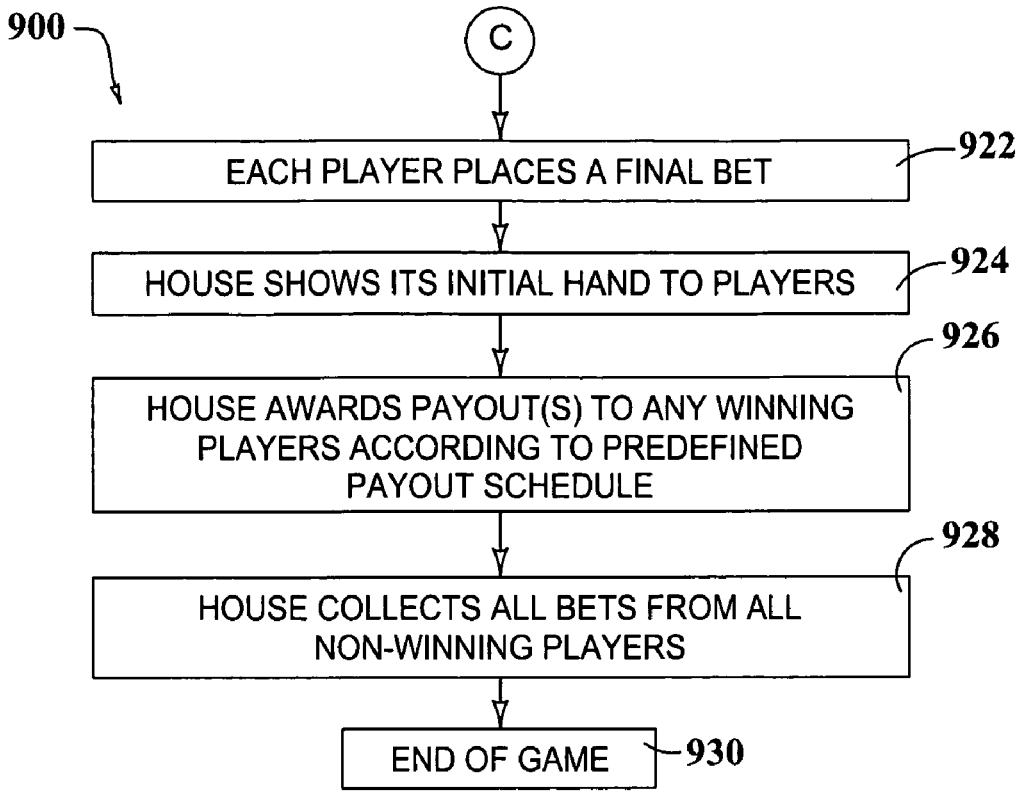
FIG. 9B is a continuation of the flowchart of FIG. 9A.

FIGS. 9A-9B collectively are a flowchart 900 depicting a method of playing a wagering game of chance in accordance with another embodiment. While the flowchart 900 describes particular steps and order of execution, it is to be understood that other embodiments that respectively include other steps and/or orders of execution can also be used in accordance with the teaching of the present disclosure. To begin, it is assumed that the house has defined a payout schedule that will govern any awards given during the present wagering game of chance. It is further assumed that a gaming table and other conventional equipment (e.g., cards, wagering chips, etc.) are used to facilitate play of the wagering game of chance.

In step 902 (FIG. 9A), each of one or more players places a first bet so as to establish their initial eligibility to play the wagering game of chance (i.e., game). In this way, each such player can be thought of (or defined to be) a first betting player. The amount of each such bet may vary from player to player, or may be the same amount for each player, in accordance with the particular embodiment of the game. Each first bet is usually made by placing a wagering chip or chips within a predetermined area on the gaming table in front of each player. In this way, each player has a corresponding area in which to place the first and any subsequent bets (described hereinafter). Other methods of placing the first bet can also be used. For purposes of example, it is assumed that each player places a first bet of five dollars value. As further depicted in step 902 of FIG. 9A, the house then accepts (i.e., acknowledges, or verifies) and collects (takes possession of) all of the first bets. In another embodiment (not shown), the house simply accepts (acknowledges) each of the first bets without presently taking possession of them.

In step 904, the house deals an initial hand to each first betting player, wherein each initial hand comprises one or more cards in a face-up condition. Thus, all players can see (or otherwise ascertain) the initial hand of each other player. For purpose of ongoing example, it is assumed that the house deals an initial hand of two cards in a face-up condition to each first betting player. Other initial hand card counts corresponding to other embodiments can also be used.

In step 906, the house now deals an initial hand to itself in a face-down condition. The initial hand of the house comprises a card count that is equal to that of each player's initial hand. Thus, for purposes of example, it is assumed that the house deals itself an initial hand of two cards in a face-down condition. Other cards counts can also be used. In any case, the initial hand of the house is presently kept secret from the players.

In step 908, each of the first betting players decides if they are to continue play of the present game, or quit (fold) at this time. Those players electing to quit proceed to step 910 below. Those players electing to continue play of the present game proceed to step 912 below.

In step 910, each player electing to fold, does so. The present instance of the game is now considered ended for any such player or players. However, each such folded player may elect to participate in a future instance of the wagering game of chance as depicted by the flowchart 900.

In step 912, each first betting player that has elected (in step 908 above) to continue play, places an additional bet in amount corresponding to the rules of the present game. In the ongoing example, it is assumed that each such player places an additional (i.e., second) bet of five dollars value within the respective wagering area in front of that player, so that one or more additional (i.e., second) betting players are defined. Other additional betting amount schemes and/or placement procedures can also be used. It is further assumed that all such additional bets are accepted by the house and left in their respect places for the present time.

In step 914, the house deals one or more 'community' cards in a face-up condition. Each of the community cards is available to be selectively combined with at least one card within each initial hand—in accordance with the present embodiment of game being played—so as to define a best present hand for each valid (i.e., betting) player. For purposes of the present example, it is assumed that three community cards are dealt in a face-up condition, such that each valid player now has a total of five available cards that can be selectively combined so as to define a present hand for that player, and that a full hand comprises a total of five cards. It is further assumed for purposes of example that each player must include both cards of their initial hand within the selective combination defining their (best) present hand of five cards. Other selective inclusion schemes can also be used. In any case, each player is now able to generally evaluate the relative strength (ranking, or value) of their best present hand in accordance with a predetermined ranking of poker hands, and in comparison with the prevailing payout schedule, while the initial hand of the house is still unknown to the player or players.

In step 916, each of the additional betting players decides whether they will quit the present game at this time, or continue play. Those players electing fold proceed to step 918 below. Those players electing to continue proceed to step 920 below.

In step 918, those players electing to fold are permitted, by the house, to 'pull back' (withdraw) their respective additional bet just placed in step 912 above. As also depicting in FIG. 9A, the house collects (takes possession of) any additional bets made by those same folding players prior to the most recent additional bet. For purposes of the ongoing example, it is assumed that each folding player pulls back their second bet, and that, for the present time, there are no prior additional bets (made during step 912) for the house to collect. In any case, the present game has ended for those players electing to pull back (withdraw) their second bet.

In step 920, the house determines if all of the community cards have been dealt in accordance with the present embodiment of wagering game. If there are no additional community cards remaining to be dealt, then the method of the flowchart 900 proceeds on to step 922 of FIG. 9B. If additional community cards remain to be dealt, then the method of the flowchart 900 proceeds back to repeat steps 912-918 above, in an iterative or "looping" fashion as needed, until all such community cards are determined to be dealt in step 920.

For purposes of ongoing example, it is assumed that the present game proceeds as follows: Step 912 is repeated, in which each second betting player electing to continue places an additional (i.e., third) bet of five dollars value, such that one or more third betting players are defined. Such third bets are accepted by the house. Thereafter, step 914 is repeated, wherein the house deals two additional (and final) community cards in a face-up condition, such that each third betting player now has a total of five community cards to selectively combine with their hand of two initial cards so as define a best present hand of five cards. Then, step 916 is repeated, wherein each additional (third) betting player elects to fold and proceed to step 918, or to continue and proceed to step 920. Thereafter, step 918 is repeated, wherein the house permits each player electing to fold (quit) to 'pull back' their respective third bet, and wherein the house collects (keeps) the first and second bets of each such folding player. Finally, the present example returns to step 920, wherein the house determines that all such community cards have been dealt. At this point, the method of the flowchart 900 proceeds to step 922 below.

In step 922 (FIG. 9B), each player who has not yet folded (e.g., in step 910 or some iteration of step 918 above), places a final bet in the respective wagering area in front of them, thus defining one or more final betting players. In the ongoing example, it is assumed that each additional (third) betting player places a final bet of five dollars value. Other wagering amounts and schemes can also be used. Thus, in the current example, each final betting player has a total of fifteen dollars value (i.e., sum of their second, third and final bets, respectively) located within their respective wagering area.

In step 924, the house shows (or otherwise reveals) it's initial hand to at least the final betting players. Typically, those players that elected to fold prior to step 924 are also in attendance and can see the house's initial hand, as well. Thus, each final betting player is now aware of the relative strength (ranking) of their best present hand (i.e., final hand) in comparison to the (best) final hand held by the house.

In step 926, the house evaluates the final hand held by each final betting player in comparison to its own. The house then makes an award to each final betting player holding a final hand superior to that of the house and in accordance with the prevailing payout schedule. For purposes of example, it is assumed that the house holds a final hand defining a pair of kings, and that a final betting player "A" holds two pair, such that player "A" defines a winning player. It is further assumed that no other final betting player holds a final hand that is superior to a pair of kings (as held by the house). Thus, under this example, it is assumed that the house then awards a 1:1 payout—an amount of fifteen dollars—to player "A" in accordance with the prevailing payout schedule. Thus, such a player "A" would reclaim their second, third and final bets totaling fifteen dollars, in addition to the fifteen dollars just awarded by the house—a total "take" of thirty dollars value. In one variation, wherein the house does not initially take possession of the first bet, any winning player receives back all of their bets, as well as the designated payout.

In step 928, the house collects all additional and/or final bets not yet collected from each final betting player that is a non-winning player (as defined in step 926 above). Thus, for example, it is assumed that other final betting players "B" and "C" are non-winning players and as such, the house collects (and keeps) their respective second, third and final bets of the present game. In another embodiment (now shown), any final betting player holding a final hand that matches (or ties) the ranking of the house's final hand is permitted to reclaim their additional and final bet(s) placed during the present game. Such a match or tie is referred to as a "push" for purposes herein. In one variation, wherein the house does not initially take possession of the first bet, any player holding a final hand that matches (or ties) the ranking of the house's final hand is permitted to reclaim all of their bets.

In step 930, the present wagering game of chance depicted by the flowchart 900 of FIGS. 9A-9B is considered complete and is ended.

The method of the flowchart 900 generally provides one possible embodiment of a wagering game of chance in accordance with certain embodiments provided for herein. Other embodiments corresponding to other steps, procedures and/or orders of execution can also be used. Various aspects and features of such embodiments can be predetermined and/or used in accordance with house rule, player agreement, or other strategy. For example, the prevailing payout schedule of an embodiment according to the method of the flowchart 900 can be predefined such that a number of final hands listed thereon receive a relatively simple award (ratio, or coefficient) of 1:1, while other, higher-ranking hands are awarded payout at a greater ratio of 2:1 (i.e., two times the total amount of the additional and final bets, etc.).

In another embodiment, each player electing to do so places a separate, non-refundable side bet at some relatively early point in the game (e.g., at step 902 of FIG. 9A, etc.). Such a side bet establishes that player's eligibility for a "bonus award"—that is, for example: the awarding of any winning final hand for that player is based upon a relatively higher payout schedule (as compared to the prevailing payout schedule applicable to non-side betting players); participation in a jackpot award given to the best (highest ranking) overall final hand held by a final betting player, etc. Other strategies and schemes making use of a side bet to add interest to the game and/or overall player incentive can also be used.

In still another embodiment, the house establishes a minimum "high card" (or cards) that must be present in a player's initial hand in order for that player to be eligible to continue play of the wagering game. For example, the house may establish that a player's initial hand must include a jack (or better) in order to continue play of the game. Otherwise, for example, each player failing to receive such a minimum card (or cards) is required to fold at step 910 of FIG. 9A, etc.

It is to be understood that the method of the flowchart 900 of FIGS. 9A-9B has been described above in the context of generally conventional card play, wherein a standard poker deck, conventional playing table (surface), wagering chips, etc., are used. However, the wagering game as depicted by the flowchart 900, or any suitably varying embodiments thereof, can also be played within a context that is at least partially automated. For example, any number of such suitable embodiments can be played by way of the wager gaming table 500 of FIG. 5, the network 600 of individual gaming machines 602 of FIG. 6, etc. Other suitable apparatus and/or devices, which are respectively electronically automated to one extent or another, can also be used in accordance with the teachings provided herein.

Figure 10A:
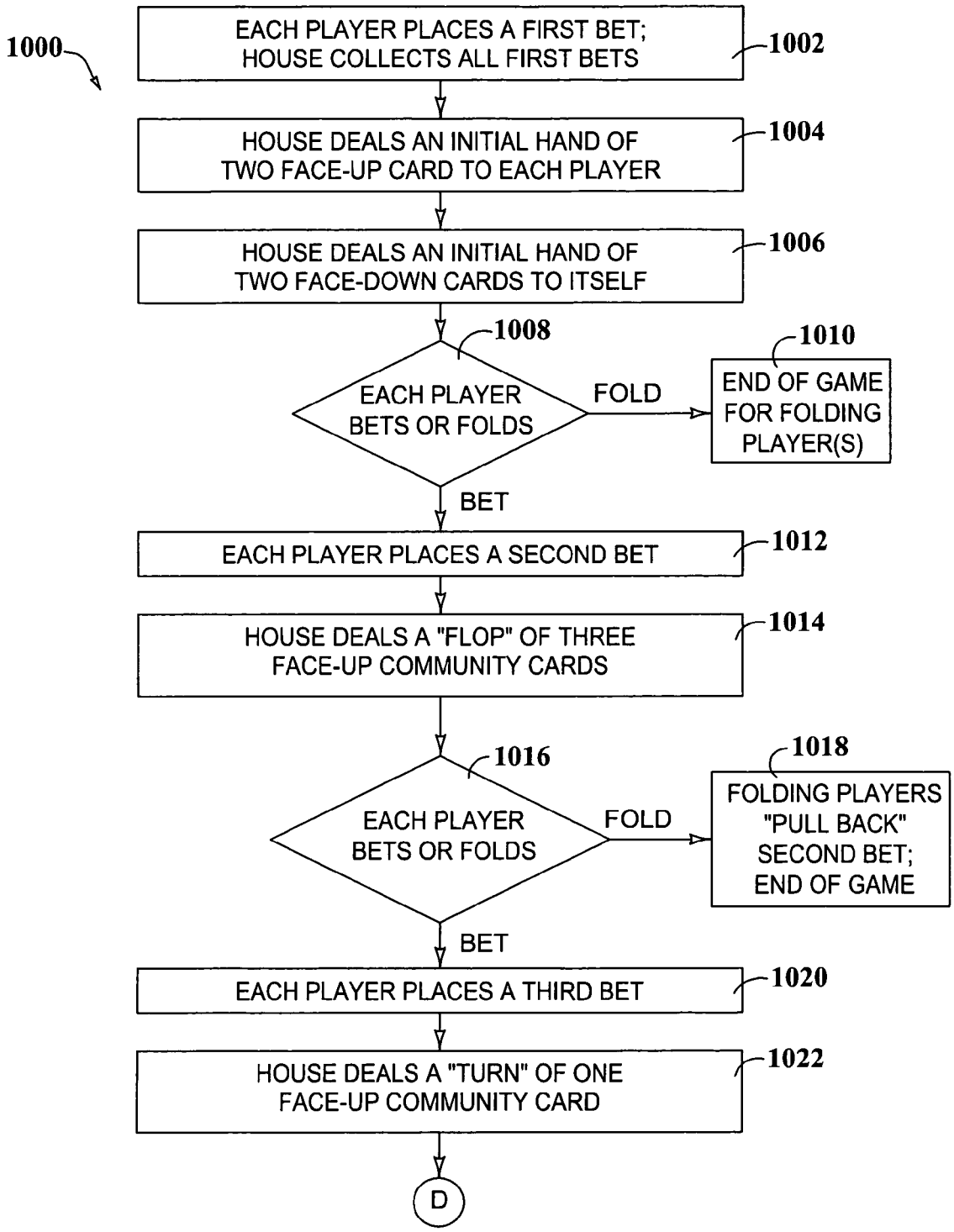
FIG. 10A is a flowchart depicting a method of playing a wagering game of chance in accordance with yet another embodiment.
Figure 10B:
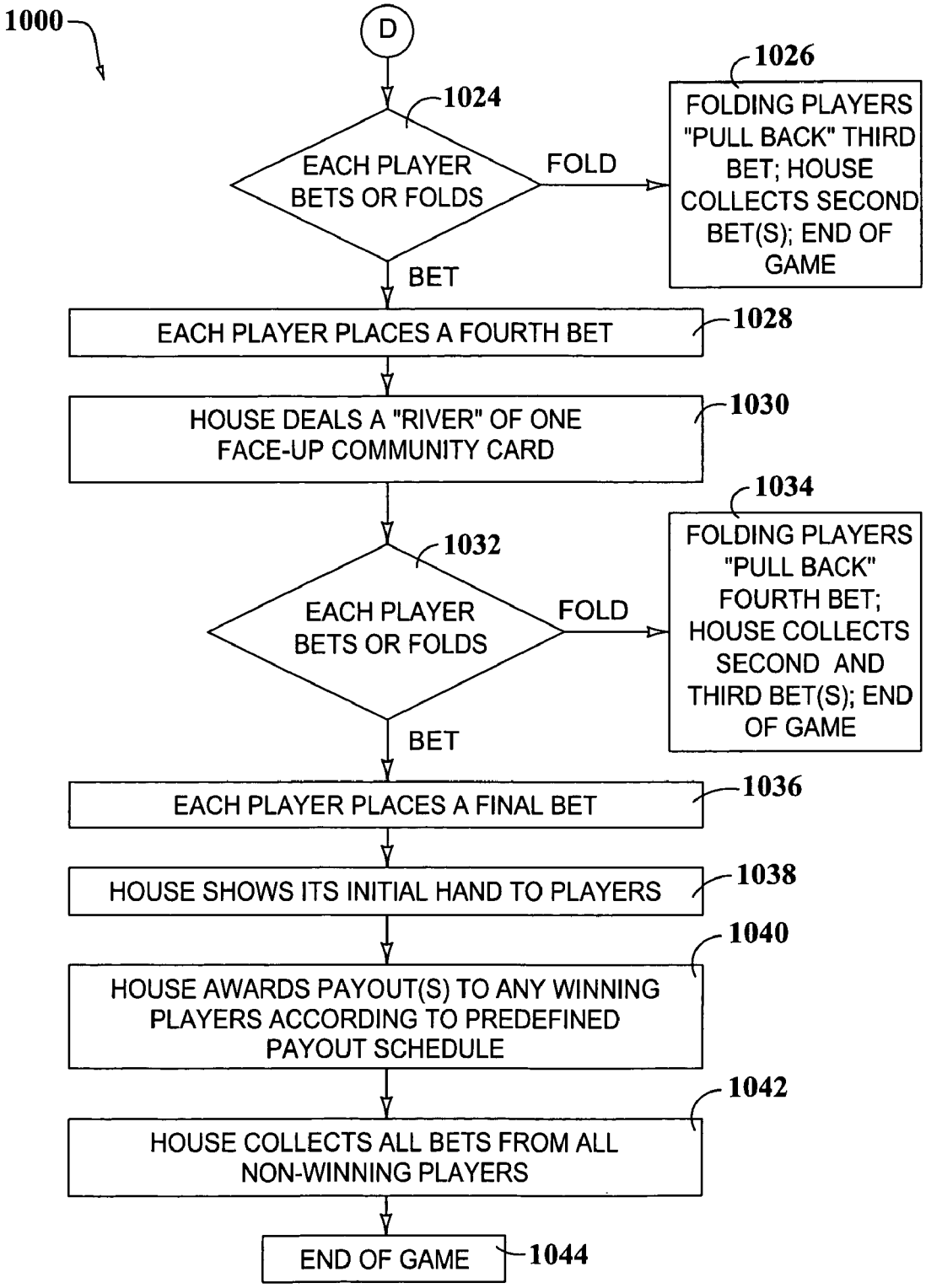
FIG. 10B is a continuation of the flowchart of FIG. 10A.

FIGS. 10A-10B collectively are a flowchart 1000 depicting a method of playing a wagering game of chance in accordance with still another embodiment. While the flowchart 1000 describes particular steps and order of execution, it is to be understood that other embodiments that respectively include other steps and/or orders of execution can also be used in accordance with the teaching of the present disclosure. To begin, it is assumed that the house has defined a payout schedule that will govern any awards given during the present wagering game of chance. It is further assumed that a gaming table and other suitable (conventional) equipment is used during play of the wagering game of chance.

In step 1002, (FIG. 10A), each of one or more players places a first bet so as to establish their initial eligibility to play the wagering game of chance. Thus, each such player is defined to be a first betting player. The amount of each first bet may vary from player to player, or may be the same amount for each player, in accordance with the particular embodiment of the game. Each first bet is usually made by placing a wagering chip or chips within a predetermined area on the gaming table in front of each player. Other methods of placing the first bet can also be used. For purposes of example, it is assumed that each player places a first bet of five dollars value. As further depicted in step 1002 of FIG. 10A, the house then accepts and collects (takes possession of) all of the first bets. In another embodiment (not shown), the house simply accepts (acknowledges) each of the first bets without presently taking possession of them.

In step 1004, the house deals an initial hand of two cards in a face-up condition to each first betting player. Thus, all players can see (or otherwise ascertain) the initial hand of each other player.

In step 1006, the house deals an initial hand of two cards in a face-down condition to itself. Therefore, the initial hand of the house is presently kept secret from the player or players.

In step 1008, each of the first betting players decides if they are to continue play of the present game, or quit (fold) at this time. Those players electing to quit proceed to step 1010 below. Those players electing to continue play of the present game proceed to step 1012 below.

In step 1010, each player electing to fold, does so. The present instance of the game is now considered ended for any such player or players. However, each such folded player may elect to participate in a future instance of the wagering game of chance as depicted by the flowchart 1000.

In step 1012, each first betting player that has elected (in step 1008 above) to continue play, places a second bet in an amount corresponding to the rules of the present game. In the ongoing example, it is assumed that each such player places a second bet of five dollars value, within the respective wagering area for that player, such that one or more second betting players are defined. Other additional betting amount schemes and/or placement procedures can also be used. It is further assumed that all such additional bets are accepted by the house and left in their respect places for the present time.

In step 1014, the house deals a "flop" of three community cards in a face-up condition. In the present embodiment, each of the (flop) community cards is available to be selectively combined with each initial hand so as to define a best present hand for each valid (second betting) player. It is assumed that, in the present embodiment, a full hand comprises a total of five cards. It is further assumed, under the present embodiment, that each player must include both cards of their initial hand within the selective combination defining their (best)

present hand of five cards. At this time, each player is able to evaluate the relative strength (ranking) of their best present hand in accordance with a predetermined ranking of poker hands, and in comparison with the prevailing payout schedule. Furthermore, the initial hand of the house is still unknown to the player or players.

In step 1016, each of the second betting players decides whether they will quit the present game at this time, or continue play. Those players electing to fold proceed to step 1018 below. Those players electing to continue proceed to step 1020 below.

In step 1018, those players electing to fold are permitted, by the house, to 'pull back' (withdraw) their respective second bets just placed in step 1012 above. Thus, each player electing to fold is permitted to reclaim their second bet. It is further noted that the house keeps possession of that player's first bet (e.g., made in step 1002 above). The present game has ended for those players electing to pull back (withdraw) their second bet.

In step 1020, each second betting player electing to continue play (in step 1016 above), places a third bet in an amount corresponding to the rules of the present game. In the ongoing example, it is assumed that each such player places a third bet of five dollars value, such that one or more third betting players are defined. Other additional betting amount schemes can also be used. It is further understood that all such third bets are accepted by the house and left in their respect places for the present time.

In step 1022, the house deals a "turn" of one community card in a face-up condition. Therefore, at this point, each third betting player has a total of four community cards that can be selectively combined with the two cards of their initial hand so as to define a best present hand for that player. Once again, each player is able to evaluate the relative strength (ranking) of their best present hand in comparison with the prevailing payout schedule. The initial hand of the house is still unknown to the player or players.

In step 1024 (FIG. 10B), each of the third betting players decides whether they will quit the present game at this time, or continue play. Those players electing to fold (quit) proceed to step 1026 below. Those players electing to continue proceed to step 1028 below.

In step 1026, those players electing to fold are permitted, by the house, to 'pull back' their respective third bets as just placed in step 1020 above. Meanwhile, the house takes and keeps possession of that player's second bet (made in step 1012 above). The present game has ended for those players electing to pull back their third bet.

In step 1028, each third betting player electing to continue (in step 1024 above), places a fourth bet in an amount corresponding to the present rules. In the ongoing example, it is assumed that each such player places fourth bet of five dollars value, such that one or more fourth betting players are defined. Other additional betting amounts can also be used. It is further understood that all such fourth bets are accepted by the house and left in their respect places for the present time.

In step 1030, the house deals a "river" of one community card in a face-up condition. Thus, each fourth betting player now has a total of five community cards that can be selectively combined with the two cards of their initial hand so as to define a best present hand (of five cards) for that player. Again, each player can evaluate the relative strength of their best present hand in comparison with the prevailing payout schedule. The initial hand of the house is still presently unknown to the player or players.

In step 1032, each of the fourth betting players decides whether they will quit the present game at this time, or continue play. Those players electing fold (quit) proceed to step 1034 below. Those players electing to continue proceed to step 1036 below.

In step 1034, those players electing to fold are permitted, by the house, to 'pull back' their respective fourth bets (as just placed in step 1028 above). Furthermore, the house takes and keeps possession of that player's second and third bets (e.g., as placed in steps 1012 and 1020 above, respectively). The present game has ended for those players electing to pull back their fourth bet.

In step 1036, each of the fourth betting player electing to continue places a final bet in an amount corresponding to the present rules. In the ongoing example, it is assumed that each such player places final bet of five dollars value, such that one or more final betting players are defined. Other additional betting amount schemes can be used. Therefore, under the present example, each final betting player has placed (generally) before them a total of twenty dollars, comprised of second, third, fourth and final bets of five dollars each. Also, the best present hand held by each final betting player defines a (best) final hand. It is further understood that all such final bets are accepted by the house and left in their respect places for the present time.

In step 1038, the house shows (or otherwise reveals) it's initial hand to at least the final betting player or players. Typically, one or more of the players that folded in steps 1010, 1018, 1026 and/or 1034 above are still present at the table (although disqualified from the present game) and can also see the initial hand of the house. In any case, each final betting player (and the house) is now able to evaluate the ranking of their respective final hand as compared to the final hand held by the house.

In step 1040, the house awards a payout to each final betting player holding a final hand that is superior to that held by the house. Any such payouts are made in accordance to the prevailing payout schedule. For purposes of the ongoing example, it is assumed that a final betting player "D" holds a final hand comprising two aces and two sevens (i.e., two pair), while another final betting player "E" holds a final hand comprising three sixes (i.e., three of a kind). Furthermore, it is assumed in this example that the house holds a final hand comprising a pair of kings. None of the other final betting players in this example holds a final hand that is superior to (i.e., that outranks) that of the house. In accordance with the prevailing payout schedule of this example, the house awards a payout (ratio) of 1:1 to player "D", and further awards a payout of 2:1 to player "E". Thus, under this example, player "D" is awarded twenty dollars from the house and is permitted to reclaim their twenty dollar total wager (i.e., second through final bets), while player "E" is awarded forty dollars from the house and is permitted to reclaim their respective twenty dollar total wager. Therefore, players "D" and "E" define winning players under the present example. In one variation, wherein the house does not initially take possession of the first bet, any winning player receives back all of their bets (i.e., first through final bets), as well as the designated payout based on the total amount bet by the player (i.e., first through final bets).

In step 1042, the house collects (and keeps) any and all second, third, fourth and final bets placed by non-winning final betting players.

In step 1044, the present wagering game of chance is considered complete and is ended.

The method of the flowchart 1000 of FIGS. 10A-10B generally provides one embodiment of a wagering game of chance in accordance with certain embodiments provided for herein. Other embodiments corresponding to other steps, procedures and/or orders of execution can also be used. Various aspects and features of such embodiments can be predetermined and/or used in accordance with house rule, player agreement, or other strategy. Any number of variations of the method of the flowchart 1000 can also be used, including any suitable such variations as described above in regard to the method of the flowchart 900 of FIGS. 9A-9B.

The method of the flowchart 1000 of FIGS. 10A-10B is understood to be generally described above in the context of conventional card play, using a standard poker deck, conventional playing table and/or wagering chips, etc. Nonetheless, the wagering game as depicted by the flowchart 1000, or any suitable variations thereof, can also be played within a context that is at least partially automated. For example, various embodiments of the method of the flowchart 1000 can be played by way of the wager gaming table 500 of FIG. 5, the network 600 of individual gaming machines 602 of FIG. 6, etc. Other suitable apparatus and/or devices, which are respectively electronically automated to one extent or another, can also be used in accordance with the teachings provided herein.

The method of the flowchart 900 (FIGS. 9A-9B), and the method of the flowchart 1000 (FIGS. 10A-10B), and any respective variations thereon, provide for embodiments of wager gaming in which each player is competing against the house—rather than the other players—and is awarded in accordance with a prevailing payout schedule (or schedules, in the event that a corresponding side betting embodiment is used). Such dynamics provides the opportunity, from time to time, for players to win with final hands that would typically be considered of relatively low rank (or value) in the context of known poker gaming play. It is this opportunity to win—by competing against a single final hand rather than several final hands—that helps to make corresponding embodiments of the present invention attractive to certain players.

Furthermore, the flowcharts 900 and 1000 depict respective embodiments in which players have the option to pull back, or withdraw, their most recent bet (other than a first bet, typically) in the interest of reducing their losses in the event of a relatively poor (low ranking) present hand. This strategic opportunity provides further player incentive and interest in corresponding embodiments of the present invention.

While the above methods and apparatus have been described in language more or less specific as to structural and methodical features, it is to be understood, however, that they are not limited to the specific features shown and described, since the means herein disclosed comprise preferred forms of putting the embodiments provided for herein into effect. The methods and apparatus are, therefore, claimed in any of their forms or modifications within the proper scope of the appended claims appropriately interpreted in accordance with the doctrine of equivalents.

Characterization

Non-limiting embodiments of the present invention can be characterized as follows:

A Gaming Table

A gaming table, comprising:

a plurality of user interfaces;

an electronic controller coupled in signal communication with each of the user interfaces, the electronic controller configured to:

define a payout schedule;

deal an initial hand to at least one player by way of a corresponding one of the user interfaces;

register a final bet from at least one player, thus defining at least one final betting player;

deal one or more community cards in a face-up condition by way of at least one of the user interfaces, wherein at least one community card is selectively combined with at least one card within each initial hand such that a final hand is defined for each final betting player; and determine an award of a payout to each final betting player holding a final hand that so qualifies in accordance with the payout schedule.

The gaming table described immediately above, wherein the electronic controller is further configured such that the payout schedule is defined in accordance with a predetermined ranking of poker hands.

The gaming table described first above, wherein the electronic controller is further configured such that:

each initial hand comprises two cards total; and each final hand comprises five cards total.

The gaming table described first above, wherein the electronic controller is further configured such that each of the initial hands is dealt in face-up condition.

The gaming table described first above, wherein the electronic controller is further configured to register at least one non-final bet from at least one player prior to the registering a final bet.

The gaming table described first above, wherein the electronic controller is further configured such that the dealing one or more community cards in a face-up condition by way of at least one of the user interfaces comprises dealing one or more community "flop" cards, and thereafter dealing one or more community "turn" cards, and thereafter dealing one or more community "river" cards.

The gaming table described first above, wherein the electronic controller is further configured to:

define a jackpot qualifying hand;

register a side bet into a progressive jackpot from at least one player, wherein each final betting player placing a side bet is also defined to be a jackpot participating player; and determine an award of the progressive jackpot to any jackpot participating player holding a final hand that is also a jackpot qualifying hand or, if no jackpot participating player has a final hand that is also a jackpot qualifying hand, repeating at least the registering a side bet and the dealing an initial hand and the registering a final bet and the dealing one or more community cards and the determining an award of a payout until the progressive jackpot is awarded.

The gaming table described first above, wherein the electronic controller is further configured to:

define a jackpot qualifying hand;

register a transfer of a predetermined portion of the final bet of at least one final betting player into a progressive jackpot prior to the determining an award of a payout from the house; and determine an award of the progressive jackpot to any final betting player holding a final hand that is also a jackpot qualifying hand or, if no final betting player has a final hand that is also a jackpot qualifying hand, repeating at least the dealing an initial hand and the registering a final bet and the dealing one or more community cards and the registering a transfer of a predetermined portion of the final bet of at least one final betting player and the determining an award of a payout until the progressive jackpot is awarded.

A Computer-Accessible Storage Media

A computer-accessible storage media including an executable program code, the executable program code configured to cause a processor to perform the following steps defining a wagering game of chance:

define a payout schedule;

deal an initial hand to at least one player;

register a final bet from at least one player, thus defining at least one final betting player;

deal one or more community cards, wherein at least one community card is selectively combined with at least one card within each initial hand such that a final hand is defined for each final betting player; and determine an award of a payout to each final betting player holding a final hand that so qualifies in accordance with the payout schedule.

The computer-accessible storage media described immediately above, wherein the executable program code is further configured to cause the processor to define the payout schedule in accordance with a predetermined ranking of poker hands.

The computer-accessible storage media described first above, wherein the executable program code is further configured such that:

each initial hand comprises two cards total; and each final hand comprises five cards total.

The computer-accessible storage media described first above, wherein the executable program code is further configured such that each of the one or more community cards is dealt in a face-up condition.

The computer-accessible storage media described first above, wherein the executable program code is further configured such that each of the initial hands is dealt in a face-up condition.

The computer-accessible storage media described first above, wherein the executable program code is further configured to cause the processor to register at least one non-final bet from at least one player prior to the registering a final bet.

The computer-accessible storage media described first above, wherein the executable program code is further configured such that the dealing one more community cards comprises dealing one or more community "flop" cards, and thereafter dealing one or more community "turn" cards, and thereafter dealing one or more community "river" cards.

The computer-accessible storage media described first above, wherein the executable program code is further configured to cause the processor to:

define a jackpot qualifying hand;

register a side bet into a progressive jackpot from at least one player, wherein each final betting player placing a side bet is also defined to be a jackpot participating player; and determine an award of the progressive jackpot to any jackpot participating player holding a final hand that is also a jackpot qualifying hand or, if no jackpot participating player has a final hand that is also a jackpot qualifying hand, repeating at least the registering a side bet and the dealing an initial hand and the registering a final bet and the dealing one or more community cards and the determining an award of a payout until the progressive jackpot is awarded.

The computer-accessible storage media described first above, wherein the executable program code is further configured to cause the processor to:

define a jackpot qualifying hand;

register a transfer of a predetermined portion of the final bet of at least one final betting player into a progressive jackpot prior to the determining an award of a payout from the house; and determine an award of the progressive jackpot to any final betting player holding a final hand that is also a jackpot qualifying hand or, if no final betting player has a final hand that is also a jackpot qualifying hand, repeating at least the dealing an initial hand and the registering a final bet and the dealing one or more community cards and the registering a transfer of a predetermined portion of the final bet of at least one final betting player and the determining an award of a payout until the progressive jackpot is awarded.

An Individual Gaming Machine

An individual gaming machine, comprising:

a user interface; and an electronic controller coupled in signal communication with the user interface, the electronic controller configured to be coupled in signal communication with at least one other electronic controller of another individual gaming machine, the electronic controller configured to:

define a payout schedule common to one or more players;

deal an initial hand in a face-up condition to a first player by way of the user interface;

register a final bet from the first player thus defining a first final betting player; and deal one or more community cards in a face-up condition by way of the user interface, wherein at least one community card is selectively combined with at least one card within the initial hand such that a final hand is defined for the first final betting player, and wherein the one or more community cards are common to the first final betting player and at least one other final betting player using another individual gaming machine; and determine an award of a payout from a house to each final betting player holding a final hand that so qualifies in accordance with the payout schedule.

The individual gaming machine described immediately above, wherein the electronic controller is further configured such that the payout schedule is defined in accordance with a predetermined ranking of poker hands.

The individual gaming machine described first above, wherein the electronic controller is further configured such that:

the initial hand comprises two cards total; and the final hand comprises five cards total.

The individual gaming machine described first above, wherein the electronic controller is further configured to register at least one non-final bet from the first player prior to the registering a final bet.

The individual gaming machine described first above, wherein the electronic controller is further configured such that the dealing one or more community cards in a face-up condition by way of the user interface comprises dealing one or more community "flop" cards, and thereafter dealing one or more community "turn" cards, and thereafter dealing one or more community "river" cards.

The individual gaming machine described first above, wherein the electronic controller is further configured to:

define a jackpot qualifying hand;

register a side bet into a progressive jackpot from at least one player, wherein each final betting player placing a side bet is also defined to be a jackpot participating player; and determine an award of the progressive jackpot to any jackpot participating player holding a final hand that is also a jackpot qualifying hand or, if no jackpot participating player has a final hand that is also a jackpot qualifying hand, repeating at least the registering a side bet and the dealing an initial hand and the registering a final bet and the dealing one or more community cards and the determining an award of a payout until the progressive jackpot is awarded.

The individual gaming machine described first above, wherein the electronic controller is further configured to:

define a jackpot qualifying hand;

register a transfer of a predetermined portion of the final bet of the first final betting player into a progressive jackpot prior to the determining an award of a payout from the house; and determine an award of the progressive jackpot to any final betting player holding a final hand that is also a jackpot qualifying hand or, if no final betting player has a final hand that is also a jackpot qualifying hand, repeating at least the dealing an initial hand and the registering a final bet and the dealing one or more community cards and the registering a transfer of a predetermined portion of the final bet of the first final betting player and the determining an award of a payout until the progressive jackpot is awarded.

A Wagering Game of Chance

A method of playing a wagering game of chance, comprising:

defining a payout schedule;

accepting a first bet from at least one player, thus defining at least one first betting player;

dealing an initial hand of at least one card in a face-up condition to each first betting player;

dealing an initial hand of at least one card in a face-down condition to a house;

dealing one or more community cards in a face-up condition;

accepting a second bet from at least one first betting player, thus defining at least one second betting player;

dealing one or more additional community cards in a face-up condition;

accepting a final bet from at least one second betting player, thus defining at least one final betting player, wherein at least one of the community cards is selectively combined with at least one card within each initial hand such that a final hand is defined for each final betting player and for the house;

showing the initial hand of the house to each final betting player; and awarding a payout to each final betting player holding a final hand that is superior to the final hand held by the house in accordance with the payout schedule.

The wagering game of chance described immediately above and further comprising permitting each second betting player to selectively pull back their corresponding second bet, thus defining at least one player for whom the wagering game of chance has ended.

A Wagering Game of Chance

A method of playing a wagering game of chance, comprising:

defining a payout schedule;

accepting a first bet from at least one player, thus defining at least one first betting player;

dealing an initial hand of two cards in a face-up condition to each first betting player;

dealing an initial hand of two cards in a face-down condition to a house;

accepting a second bet from at least one first betting player, thus defining at least one second betting player;

dealing three community cards in a face-up condition;

permitting each second betting player to selectively pull back their corresponding second bet, thus defining each such player as a player for whom the wagering game of chance has ended;

accepting a third bet from at least one second betting player, thus defining at least one third betting player;

dealing one community card in a face-up condition;

permitting each third betting player to selectively pull back their corresponding third bet, thus designating any such players as players for whom the wagering game of chance has ended;

accepting a fourth bet from at least one third betting player, thus defining at least one fourth betting player;

dealing one community card in a face-up condition;

permitting each fourth betting player to selectively pull back their corresponding fourth bet, thus designating any such players as players for whom the wagering game of chance has ended;

accepting a final bet from at least one fourth betting player, thus defining at least one final betting player, wherein each of the community cards is selectively combined with at least one card within each initial hand so as to define a final hand of five cards for each final betting player and for the house;

showing the initial hand of the house to each final betting player; and awarding a payout to each final betting player holding a final hand that is superior to the final hand held by the house in accordance with the payout schedule.

I claim:

1. A method of playing a wagering game of chance, comprising:

defining multiple payout schedules;

selecting one of the payout schedules by a player vote;

dealing an initial hand to at least one player;

accepting a final bet from the at least one player, thus defining at least one final betting player;

dealing one or more community cards, wherein at least one community card is selectively combined with at least one card within each initial hand such that a final hand is defined for each final betting player; and awarding a payout to each final betting player holding a final hand that so qualifies in accordance with the selected payout schedule, wherein at least two players play the wagering game of chance by way of respective individual gaming machines, and the individual gaming machines are coupled in signal communication; and each player casts a vote for the payout schedule at the respective individual gaming machine of the player.

2. The method of claim 1, wherein at least one of the multiple payout schedules is defined in accordance with a predetermined ranking of poker hands.

3. The method of claim 1, wherein each final hand comprises five cards total.

4. The method of claim 1, the method further comprising:

accepting a non-final bet from at least one player, thus defining at least one non-final betting player;

dealing one of the community cards;

returning a non-final bet to a non-final betting player when the non-final betting player folds after the house deals the community card; and the house taking possession of the final bet of at least one final betting player not awarded a payout.

5. The method of claim 1, wherein each of the one or more community cards is dealt in a face-up condition.

6. The method of claim 1, wherein each of the initial hands is dealt in a face-up condition.

7. The method of claim 1, the method further comprising accepting at least one non-final bet from the at least one player prior to the accepting a final bet.

8. The method of claim 1, wherein:

the dealing one or more community cards comprises dealing one or more community "flop" cards, and thereafter dealing one or more community "turn" cards, and thereafter dealing one or more community "river" cards; and the accepting a final bet is performed prior to the dealing one or more community river cards.

9. The method of claim 1, and further comprising:

defining a jackpot qualifying hand;

accepting a side bet into a progressive jackpot from the at least one player, wherein each final betting player placing a side bet is also defined to be a jackpot participating player; and awarding the progressive jackpot to any jackpot participating player holding a final hand that is also a jackpot qualifying hand or, if no jackpot participating player has a final hand that is also jackpot qualifying hand, repeating the wagering game of chance until the progressive jackpot is awarded.

10. The method of claim 1, the method further comprising:

defining a jackpot qualifying hand;

transferring a predetermined portion of the final bet of at least one final betting player into a progressive jackpot; and awarding the progressive jackpot to any final betting player holding a final hand that is also a jackpot qualifying hand or, if no final betting player has a final hand that is also jackpot qualifying hand, repeating the wagering game of chance until the progressive jackpot is awarded.

11. The method of claim 10, wherein the progressive jackpot includes at least one predetermined portion of a final bet transferred during a prior play of the wagering game of chance.

12. The method of claim 1, wherein each initial hand comprises two cards total.

13. A method of playing a wagering game of chance, comprising:

defining multiple payout schedules;

selecting one of the payout schedules by a player vote;

accepting an initial bet from at least one player, thus defining at least one initial betting player;

dealing an initial hand to each initial betting player;

accepting a first bet from at least one initial betting player, thus defining at least one first betting player;

dealing a "flop" of at least one community card;

accepting a second bet from at least one first betting player, thus defining at least one second betting player;

dealing a "turn" of at least one community card;

accepting a third bet from at least one second betting player, thus defining at least one final betting player;

dealing a "river" of least one community card, wherein each of the "flop" and "turn" and "river" community cards is selectively combined with at least one card within each initial hand so as to define a final hand for each final betting player; and awarding a payout from a house to each final betting player holding a final hand that so qualifies in accordance with the selected payout schedule, wherein at least two players play the wagering game of chance by way of respective individual gaming machines; and the individual gaming machines are coupled in signal communication; each player casts a vote for one of the payout schedules at the respective individual gaming machine of the player.

14. The method of claim 13, and further comprising:

accepting a non-final bet from at least one player, thus defining at least one non-final betting player;

dealing one of the community cards;

returning a non-final bet to a non-final betting player when the non-final betting player folds after the house deals the community card; and the house taking possession of the initial bet and the first bet and the second bet and the third bet of at least one final betting player not awarded a payout.

15. The method of claim 13, wherein at least one of the multiple payout schedules is defined in accordance with a predefined ranking of poker hands.

16. The method of claim 13, wherein each final hand comprises five cards total.

17. The method of claim 13, wherein each initial hand comprises two cards total.

18. The method of claim 13, wherein each of the initial hands is dealt in a face-up condition.

19. The method of claim 13, wherein each of the "flop" and "turn" and "river" community cards is dealt in a face-up condition.

20. The method of claim 13, and further comprising:

defining a jackpot qualifying hand;

accepting a side bet into a progressive jackpot from at least one player, wherein each final betting player placing a side bet is also defined to be a jackpot participating player; and awarding the progressive jackpot to any jackpot participating player holding a final hand that is also a jackpot qualifying hand or, if no jackpot participating player has a final hand that is also jackpot qualifying hand, repeating the wagering game of chance until the progressive jackpot is awarded.

21. The method of claim 13, and further comprising:

defining a jackpot qualifying hand;

transferring a predetermined portion of the total of the initial bet and the first bet and the second bet and the third bet of at least one final betting player into a progressive jackpot; and awarding the progressive jackpot to any final betting player holding a final hand that is also a jackpot qualifying hand or, if no final betting player has a final hand that is also jackpot qualifying hand, repeating the wagering game of chance until the progressive jackpot is awarded.

* * * * *